US010792727B2

(12) United States Patent
Christofilis et al.

(10) Patent No.: US 10,792,727 B2
(45) **Date of Patent: *Oct. 6, 2020**

(54) DEVICES, SYSTEMS AND METHODS FOR AUTOMATED WIRE BENDING

(71) Applicant: Automated Industrial Machinery, Inc., Addison, IL (US)

(72) Inventors: Tom J. Christofilis, Oakbrook Terrace, IL (US); Constantine S. Grapsas, Oak Brook, IL (US)

(73) Assignee: AIM, Inc., Addison, IL (US)

( * ) Notice: Subject to any disclaimer, the term of this patent is extended or adjusted under 35 U.S.C. 154(b) by 277 days.

This patent is subject to a terminal disclaimer.

(21) Appl. No.: 15/457,110

(22) Filed: Mar. 13, 2017

(65) Prior Publication Data

US 2017/0182544 A1 Jun. 29, 2017

Related U.S. Application Data

(63) Continuation of application No. 14/159,700, filed on Jan. 21, 2014, now Pat. No. 9,592,546, which is a continuation of application No. 12/639,227, filed on Dec. 16, 2009, now Pat. No. 8,631,674.

(60) Provisional application No. 61/138,427, filed on Dec. 17, 2008.

(51) Int. Cl.

| | |
|---|---|
| ***B21F 1/06*** | (2006.01) |
| ***B21F 1/00*** | (2006.01) |
| ***B21D 7/12*** | (2006.01) |
| ***B21F 1/02*** | (2006.01) |
| ***B21D 11/12*** | (2006.01) |

(52) U.S. Cl.

CPC ..... *B21F 1/06* (2013.01); *B21D 7/12* (2013.01); *B21D 11/12* (2013.01); *B21F 1/00* (2013.01)

(58) Field of Classification Search

CPC .... B21F 1/00; B21F 1/06; B21F 1/006; B21F 1/008; B21F 1/026; B21D 11/12; B21D 7/12

USPC ..... 29/896.4, 896.41, 896.43; 140/92.1, 102, 140/102.5, 123; 72/203, 381, 383, 298, 72/306, 307, 310, 215–217, 387, 388

See application file for complete search history.

(56) References Cited

U.S. PATENT DOCUMENTS

| | | | | |
|---|---|---|---|---|
| 4,989,429 A * | 2/1991 | Del Fabro | ..... | B21D 7/022 72/217 |
| 8,631,674 B2 * | 1/2014 | Christofilis | ..... | B21D 7/12 72/306 |
| 2010/0147048 A1 * | 6/2010 | Christofilis | ..... | B21D 11/12 72/372 |

* cited by examiner

*Primary Examiner* — Lawrence Averick

(74) *Attorney, Agent, or Firm* — Moazzam & Associates, LLC

(57) ABSTRACT

Devices, systems and methods are disclosed which relate to a wire bending apparatus capable of both on and off-plane nose and mandrel bends. Exemplary embodiments of the present invention incorporate a center turret cluster with a plurality of radii possible, a nose-bending mandrel, and a mandrel-bending mandrel. This apparatus forms a bending head that is attached to a CNC wire bending machine. This combination allows increased flexibility in forming complex wire forms and cuts down secondary operations, such as operations from robot arms, sometimes associated with CNC wire bending. In addition, the turret cluster position in the center allows for bending support with mandrel bends or nose bending on the back side of the bending head, usually 180 degrees away from the normal bending area. This allows the manufacturing of double end-loop forms without the addition of external clamps or robotic manipulation.

19 Claims, 26 Drawing Sheets

Fig. 4C
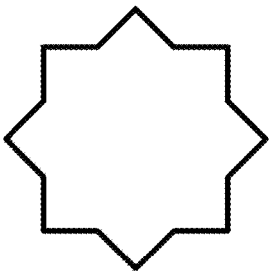
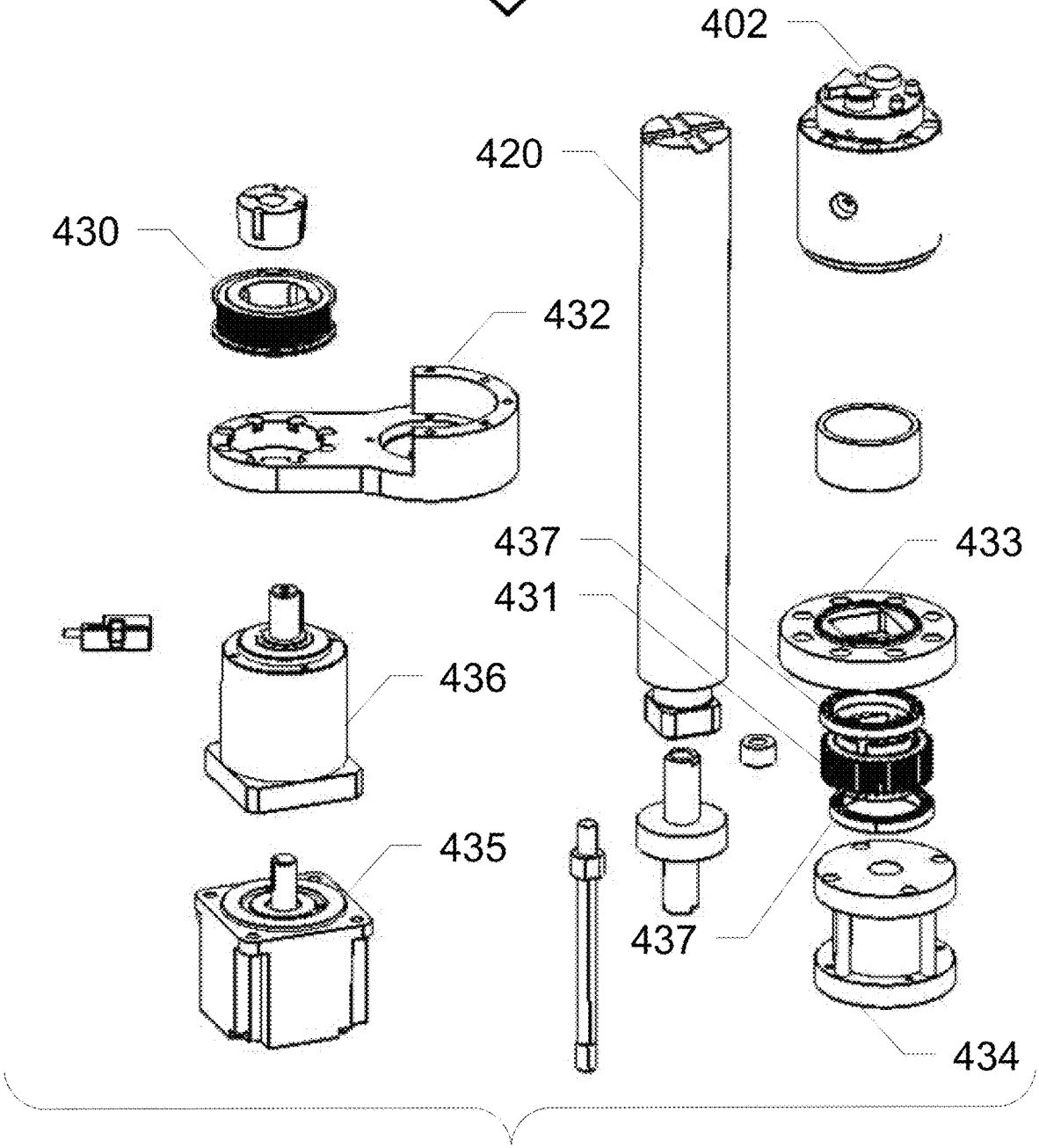
Fig. 4D

DEVICES, SYSTEMS AND METHODS FOR AUTOMATED WIRE BENDING

This U.S. patent application is a continuation of U.S. patent application Ser. No. 14/159,700, filed Jan. 21, 2014, now U.S. Pat. No. 9,592,546; which is a continuation of U.S. patent application Ser. No. 12/639,227, filed Dec. 16, 2009, now U.S. Pat. No. 8,631,674; which claims priority to U.S. Provisional Patent Application Ser. No. 61/138,427, filed Dec. 17, 2008; the contents of which are hereby incorporated by reference herein in their entirety into this disclosure.

BACKGROUND OF THE INVENTION

Field of the Invention

The present invention relates to wire bending. More specifically, the present invention relates to wire bending heads capable of on and off-plane nose and mandrel bends using the same machine.

Background of the Invention

Bending machines are used to create accurate and complex bends. Bending machines may be operated through computer numerical control (CNC). CNC benders allow a user to design a shape, and have the machine create a shape of consistent specification and quality. For instance, the creation of grocery carts requires many precise bends which are not easy to manually execute.

Wire bending machines are used with various kinds of wire. CNC benders feed wire directly from a coil stock to a bending mechanism. The size of the wire used in such machines can range in diameter, with no major tool changes necessary to interchange wire. Wire bending machines may be used to create precise parts.

Currently, many people bend wire using mandrel bending or nose bending styles. Current limitations exist with the amount of bending radii possible on a tool. Conventional nose bending has capabilities of one radius to four or even eight radii, depending on tooling. The tool used for nose bending is called a turret cluster. The turret cluster normally has 4 different radii, but in some cases may have 8 different radii for left or right bending.

Nose bending is a more robust style of bending, especially when using very small radii less than one-half of the wire diameter. The tool life remains robust because the tool is built from a strong material in the form of a triangle with enough material to support the bend. Nose bending is a process by which a wire is held between two holding pins, while a bending pin sweeps the wire to a side, bending it against one of the two holding pins. This is typically accomplished by feeding a wire through two holding pins. The bending pin is attached to a large block having more than one bending pin, which slides circumferentially about the two holding pins. Only one bending pin on the large block is engaged at a time. It can bend against either of the two holding pins, and can bend to virtually any angle. Two-dimensional nose bending is a common form of wire bending because the moving parts are kept to a minimum. Three-dimensional nose bending is possible with the addition of a bending head that rotates around a wire.

Mandrel bending has advantages such as being able to form a complete loop all the way around until the end of the wire touches the leading edge of the wire. A complete loop is formed in one motion as opposed to nose bending where a complete loop requires two or more motions. A mandrel-bending tool is usually smaller than a nose-bending tool. Mandrel bending has become more popular because it takes less time to form an entire loop than with nose bending.

Nose bending can form loops, but it takes three or more bends, and the loop is not perfect. A "loop" made by nose bending has noticeable angles and edges around the perimeter. However, a mandrel-bending tool can only create a loop having a predetermined diameter. In order to make a loop having another diameter, another mandrel-bending tool will need to be used.

However, many combinations of nose and mandrel bends currently involve multiple machines or robot arms. For example, a double loop cannot be made without a robot arm. What is needed is a device capable of making both nose and mandrel bends, and also capable of off-plane bending without the use of an external arm or clamp.

SUMMARY OF THE INVENTION

The present invention is a wire bending apparatus capable of both on and off-plane nose and mandrel bends. Exemplary embodiments of the present invention incorporate a center turret cluster with a plurality of radii possible, a nose-bending mandrel, and a mandrel-bending mandrel. This apparatus forms a bending head that is attached to a CNC wire bending machine. This combination allows increased flexibility in forming complex wire forms and cuts down secondary operations, such as operations from robot arms. In addition, the turret cluster position in the center allows for bending support with mandrel bends or nose bending on the back side of the bending head, usually 180 degrees away from the normal bending area. This allows the manufacturing of double ended loop forms without the addition of external clamps or robotic manipulation.

In one exemplary embodiment, the present invention is a bending head for a wire bending device. The bending head includes a bending surface, a turret cluster coupled to the bending surface, a mandrel-bending mandrel coupled to the bending surface, and a nose-bending mandrel coupled to the bending surface. The wire bending device is capable of creating an off-plane bend.

In another exemplary embodiment, the present invention is a method of wire bending of the type using a CNC wire bending machine. The method includes mandrel bending a complete loop around an end of a wire, nose bending the wire, and off-plane bending the wire. Each bend is performed without using secondary operations.

In yet another exemplary embodiment, the present invention is a method of wire bending of the type using a CNC wire bending machine. The method includes mandrel bending a complete loop at a first end of a wire, feeding the wire in a forward direction along a centerline, cutting the wire forming a second end of the wire, pinching the wire between a turret cluster and a mandrel bender, and mandrel bending a complete loop at the second end of the wire. The complete loops at the first and second ends of the wire are formed without secondary operations.

BRIEF DESCRIPTION OF THE DRAWINGS

FIG. 4C shows an aperture of a shell disc yielding eight possible orientations, according to an exemplary embodiment of the present invention.

FIG. 4D shows an exploded view of the components used in rotation of the turret cluster, according to an exemplary embodiment of the present invention.

DETAILED DESCRIPTION OF THE INVENTION

Figure 1:
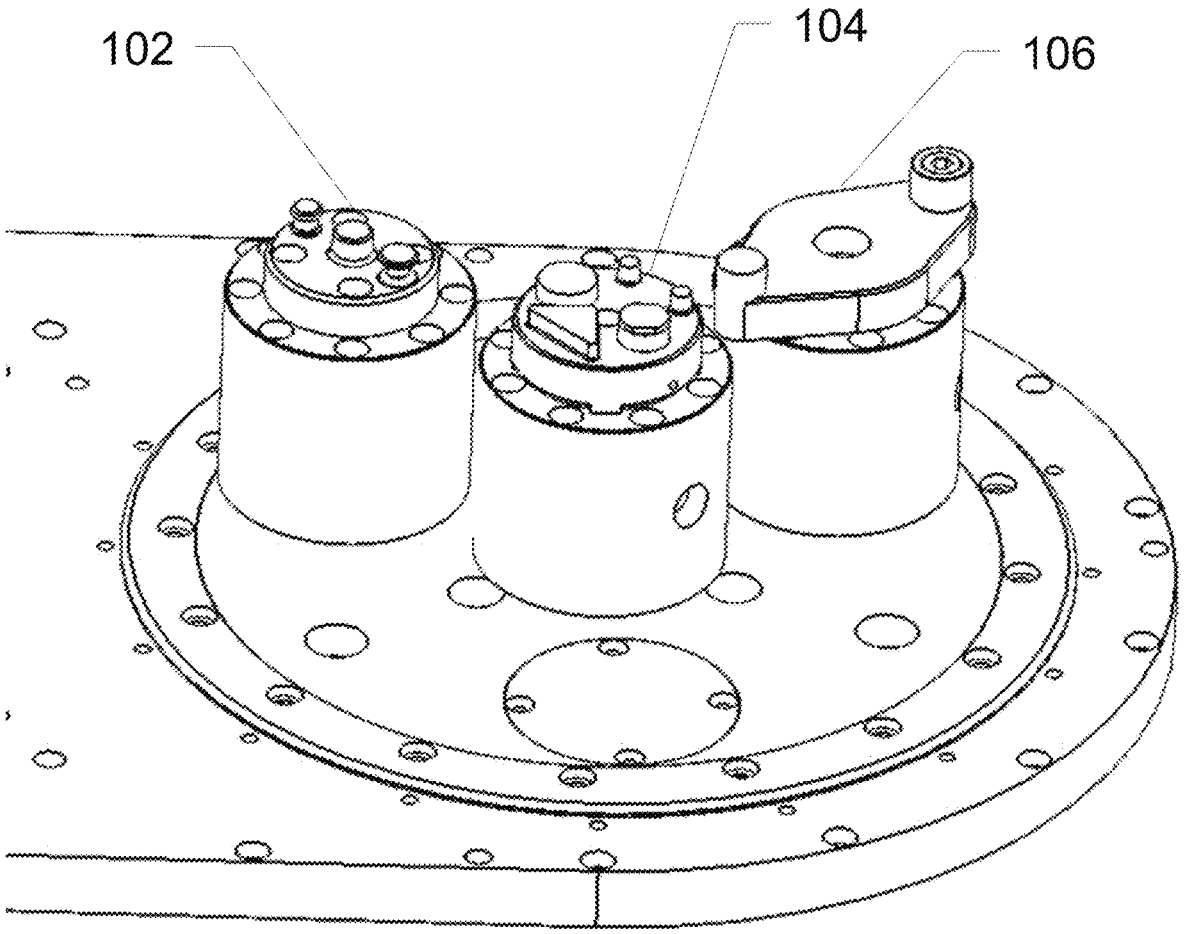
FIG. 1 shows surface components of a bending head, according to an exemplary embodiment of the present invention.

The present invention is a wire bending apparatus capable of both on and off-plane nose and mandrel bends. Exemplary embodiments of the present invention incorporate a center turret cluster with a plurality of radii possible, a nose-bending mandrel, and a mandrel-bending mandrel. This apparatus forms a bending head that is attached to a CNC wire bending machine. This combination allows increased flexibility in forming complex wire forms and cuts down secondary operations, such as operations from robot arms. In addition, the turret cluster position in the center allows for bending support with mandrel bends or nose bending on the back side of the bending head, usually 180 degrees away from the normal bending area. This allows the manufacturing of double end-loop wires without the addition of external clamps or robotic manipulation.

For the following description, it can be assumed that most correspondingly labeled structures across the figures (e.g., 132 and 232, etc.) possess the same characteristics and are subject to the same structure and function. If there is a difference between correspondingly labeled elements that is not pointed out, and this difference results in a non-corresponding structure or function of an element for a particular embodiment, then that conflicting description given for that particular embodiment shall govern.

The bending head comprises three main surface components which physically bend a wire: a turret cluster, a mandrel-bending mandrel, and a nose-bending mandrel. Each of these components can raise, lower, and spin. The mandrels can also revolve around the turret cluster. The machinery within the bending head can be broken down by functions of the surface components. A turret assembly, mandrel assembly, mandrel rotator assembly, and bender rotator assembly form the major components of the bending head. A "bending surface", as used herein, refers to the surface upon which a wire is fed and bent. This is the surface that features the tools which come in contact with the wire for bending.

The nose-bending mandrel is unlike any other nose-bending device used in wire bending in that it employs a mandrel as its base. Instead of a block revolving around the turret cluster, the nose-bending mandrel can rotate about its own center axis as well as revolve around the turret cluster. To accomplish this, a mandrel assembly is used, but a nose-bending tool is attached to the top. Instead of having retractable pins, the nose-bending mandrel has a pin on each side. The nose-bending mandrel simply rotates to engage the correct bending pin. For other applications, the nose-bending tool can be replaced with a nose-bending tool having pins of a different size or quality, or even a mandrel-bending tool.

Another feature of this design, along with the combination of nose and mandrel bending, is the capability of forming parts "off plane" from the normal wire line. Conventional bending is performed on a wire fed through the center of the bending surface. This center line on which the wire is fed is referred to as the "wire centerline axis". "Off plane" bending refers to a bend where the mandrel-bending or nose-bending mandrel positions itself off of the centerline of the wire, bending the wire off the normal wire centerline axis. This feature is beneficial in forming complex parts or avoiding any collisions of the wire form with the bending head. Exemplary embodiments of the present invention perform off plane bends without the need for robot arms or other secondary operations.

Unless specified otherwise, all of the components of the bending head are made from a strong and durable metal, such as steel, to handle the large loads the bending head exerts. The wire being bent is usually metal and ranges in diameter from small to large.

FIG. 1 shows the surface components of a bending head, according to an exemplary embodiment of the present invention. The surface components comprise a turret cluster 102, a mandrel-bending mandrel 104, and a nose-bending mandrel 106. These three components are responsible for almost all of the actual wire bends. Each of these components can raise, lower, and spin. The mandrels can also revolve around turret cluster 102.

In other exemplary embodiments there can be more than two mandrels. FIG. 1 shows two mandrels spaced about 120 degrees apart leaving more than enough room for a third or even fourth and fifth mandrels. The number of mandrels is only limited by the surface area available around the turret cluster against the size of each mandrel.

Figure 2A:
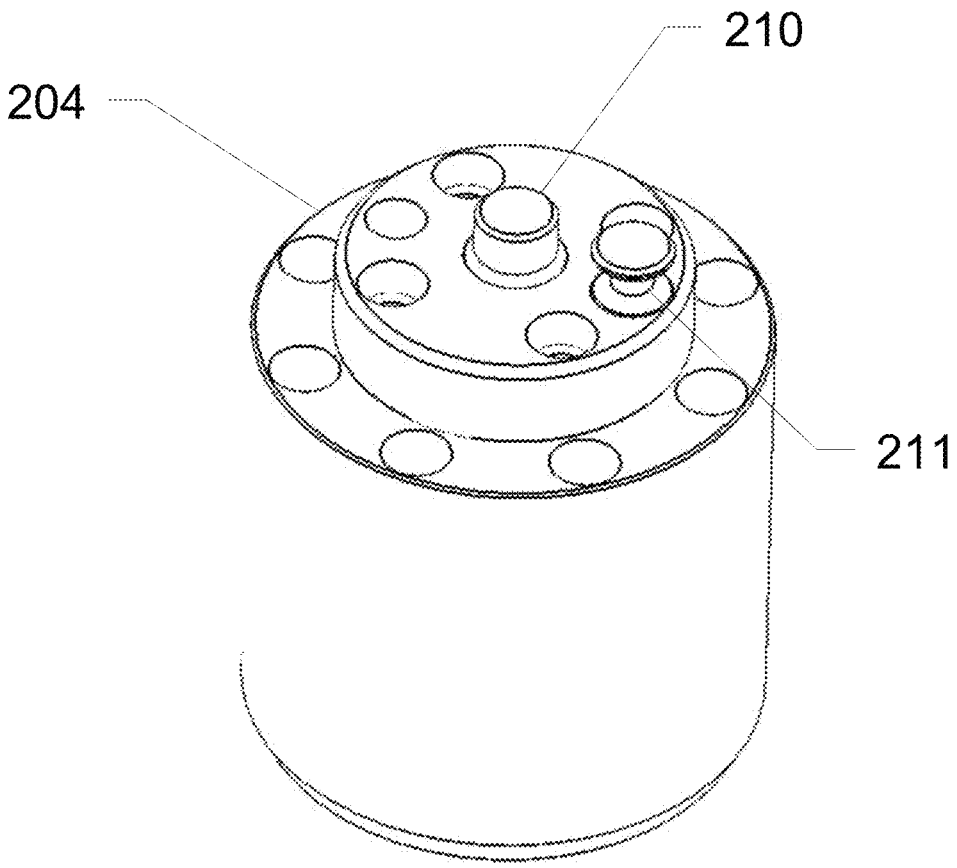
FIG. 2A shows a mandrel bending head, according to an exemplary embodiment of the present invention.

FIG. 2A shows a mandrel bending head 204 having two pins on its top surface: a central pin 210 and a satellite pin 211, according to an exemplary embodiment of the present invention. The end of a wire is positioned in between central pin 210 and satellite pin 211 in order for mandrel bending head 204 to rotate and bend the wire. The radius of curvature of the bend is consistent with the radius of central pin 210. In practice, a small section of wire is bent slightly so that satellite pin 211 catches the wire at the bend which helps pull the wire around central pin 210 in performing a mandrel bend. An example of this is explained hereinafter in FIGS. 15 and 16.

Because the radius of curvature in a mandrel bend is consistent, and thus dependent, on the radius of the central pin, additional mandrel-bending mandrels are desirable. Further exemplary embodiments have additional mandrels with central pins in various sizes.

Figure 2B:
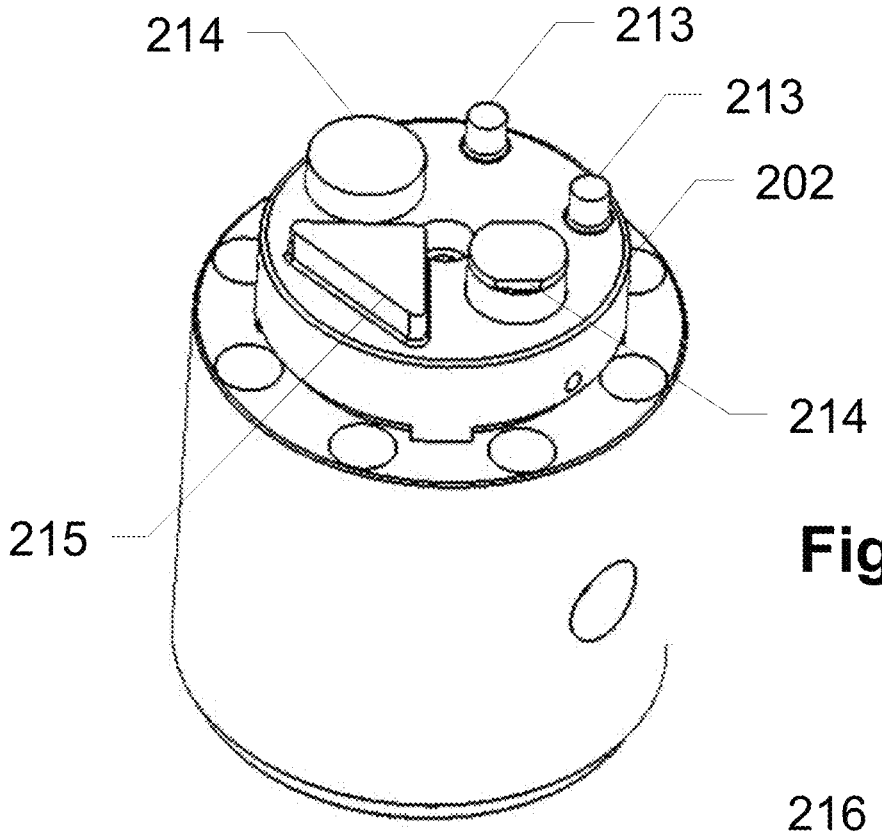
FIG. 2B shows a turret cluster, according to an exemplary embodiment of the present invention.

FIG. 2B shows a turret cluster 202 having two small pins 213, two large pins 214, and a triangular block 215, according to an exemplary embodiment of the present invention. Wire is fed through the center of turret cluster 202. Turret cluster 202 rotates so that the wire can be fed through the center between any two adjacent pins or triangular block 215. Once in position, nose-bending mandrel 206 bends the wire at an angle around one of the pins or one of the corners of triangular block 215. Each pin and corner yields a different radius of curvature. Turret cluster 202 has four possible orientations, each orientation being a 90-degree turn from the next. A wire must be fed through the center of turret cluster 202, which means in any of the four orientations the wire is always between triangular block 215 and large pin 214 on one side and between large pin 214 and small pin 213 on the other side. A nose bend is normally performed against one of the pins or triangular block 215 oriented at the exit of the wire.

While the turret cluster shown in FIG. 2B is capable of four orientations, exemplary embodiments feature turret clusters capable of eight or more orientations. An eight-orientation turret cluster may have more variations in pin sizes to make more possible radii of curvature.

Figure 2C:
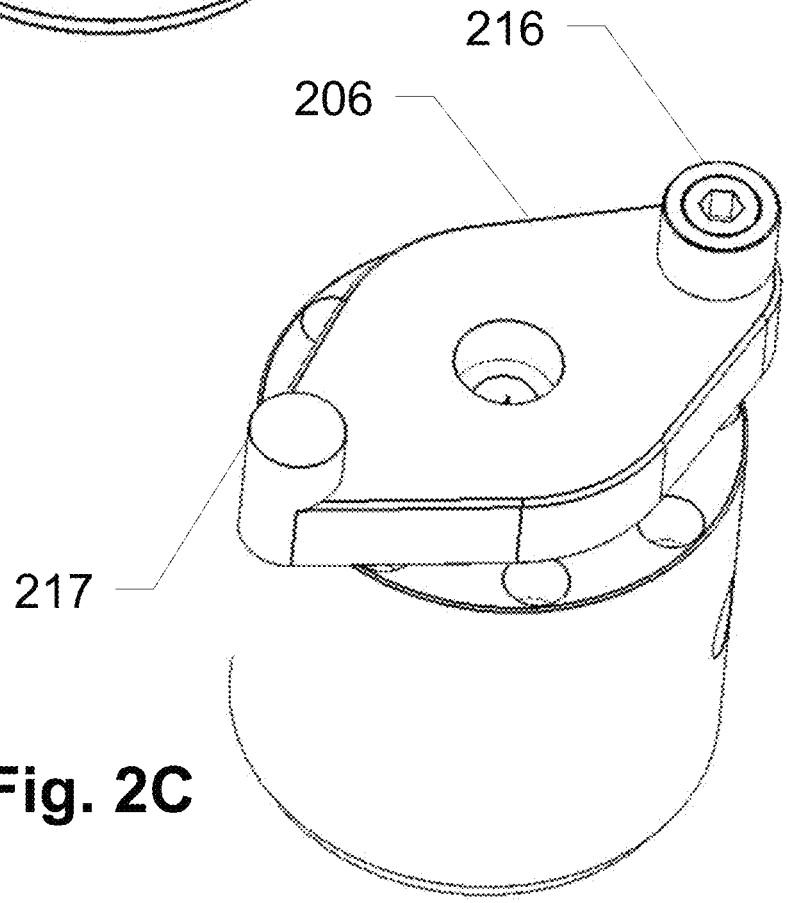
FIG. 2C shows a nose bending head, according to an exemplary embodiment of the present invention.

FIG. 2C shows a nose-bending mandrel 206 having a strong pin 216 and a bearing pin 217, according to an exemplary embodiment of the present invention. Nose-bending mandrel 206 revolves around turret cluster 202 to bend the wire around a target pin or corner of triangular block 215. The bend can be at virtually any angle, which is determined by how far nose-bending mandrel 206 revolves around turret cluster 202. Strong pin 216 is used for nose-bends that bend the wire at sharp angles or for bending strong wire. Bearing pin 217 is used for nose-bends of softer wire. Strong pin 216 lasts roughly ten times longer than bearing pin 217, but bearing pin 217 leaves less manufacturing marks on the finished wire.

The two pins on the nose-bending mandrel are located at opposite ends of the mandrel so that the pin not used in a bend does not interfere with the bending pin. Other exemplary embodiments have varying amounts of bending pins on the nose-bending mandrel. Having only one pin on a nose-bending mandrel ensures nothing interferes with the bend, but two pins still renders interference unlikely. With three or more pins interference becomes more of a concern. Certain applications allow the use of more than two pins, but the concern becomes design specific. Conventional nose bends are typically not made using a nose-bending mandrel, but are made using a retractable pin. More than one pin is available on conventional models, but they are not mounted on a rotating mandrel as shown in FIG. 2C. Exemplary embodiments of the present invention have a nose-bending pin on a rotating mandrel. Other embodiments have two nose-bending pins on either side of a rotating mandrel such as in FIG. 2C. As explained hereinafter in FIG. 3, the structural difference between a mandrel-bending mandrel and a nose-bending mandrel is the tool on top. An advantage of this design is the simplicity in converting a nose-bending mandrel to a mandrel-bending mandrel and vice-versa. A particular wire form may require many different nose and mandrel bends of different sized radii, which can be accommodated by having many mandrels capable of mandrel or nose bending.

Figure 3A:
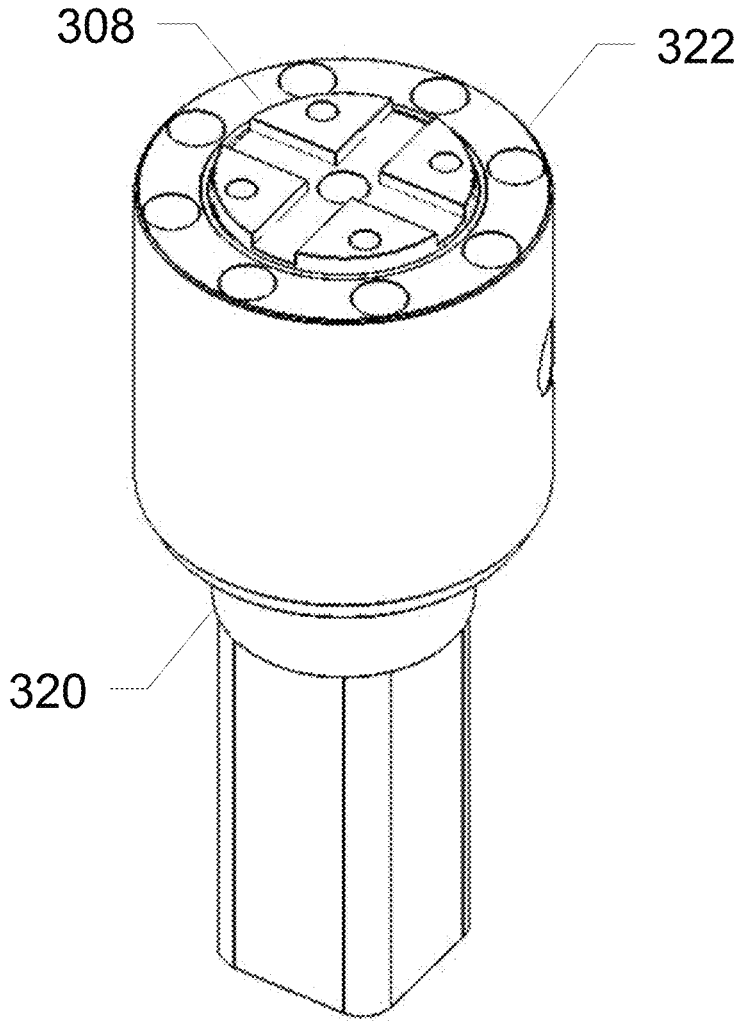
FIG. 3A shows the components of a blank mandrel, according to an exemplary embodiment of the present invention.
Figure 3B:
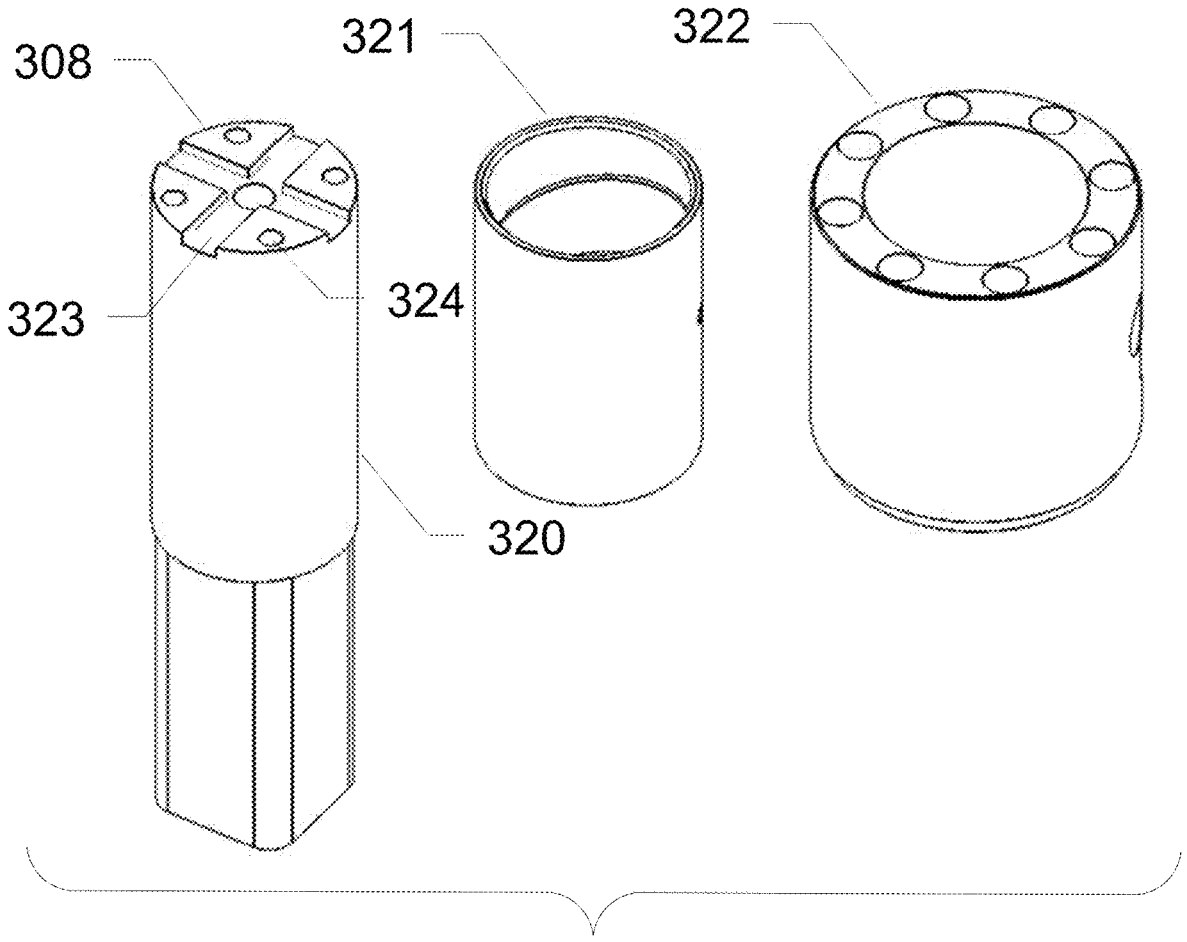
FIG. 3B shows an exploded view of the components of a blank mandrel, according to an exemplary embodiment of the present invention.

FIGS. 3A and 3B show the components of a mandrel assembly comprising a tool connector 308, a shaft 320, a sleeve 321, and a shaft support 322. Tool connector 308 is designed with surface grooves 323 which match protrusions on the underside of a mandrel-bending tool or nose-bending tool to prevent relative rotation between tool connector 308 and the mandrel-bending or nose-bending tool. Tool connector 308 also comprises one or more throughbores 324. One or more fasteners such as screws or bolts are used to fix a mandrel-bending or nose-bending tool to tool connector 308. A mandrel-bending tool fixed to tool connector 308 can be removed and replaced with a nose-bending tool or any other suitable bending tool. Shaft 320 is cylindrically shaped where shaft support 322 surrounds it. The opposite end of shaft 320 has a square-shaped cross-sectional area which aids in the rotating of the mandrel explained hereinafter. Sleeve 321 surrounds shaft 320, but is inside shaft support 322, which surrounds sleeve 321. Sleeve 321 serves as a frictional layer to ensure that shaft support 322 rotates in unison with shaft 320. Shaft 320 is designed to bend wire while rotating, which puts a torque on the shaft. This torque stresses shaft 320 which may cause shaft 320 to fail after a while. Shaft support 322 reinforces shaft 320 so that it can endure more torque and stress before failure.

In alternate exemplary embodiments the tool connector utilizes other fasteners to connect a mandrel-bending or nose-bending tool. The matching grooves and protrusions that prevent relative angular motion between the tool and the tool connector can be replaced by a keystone inserted off-center through both the tool connector and the tool. More than one fastener can be utilized to prevent this relative angular motion as well. Other methods of preventing this relative angular motion between the tool and tool connector will be readily recognizable to those having skill in the art.

Figure 4A:
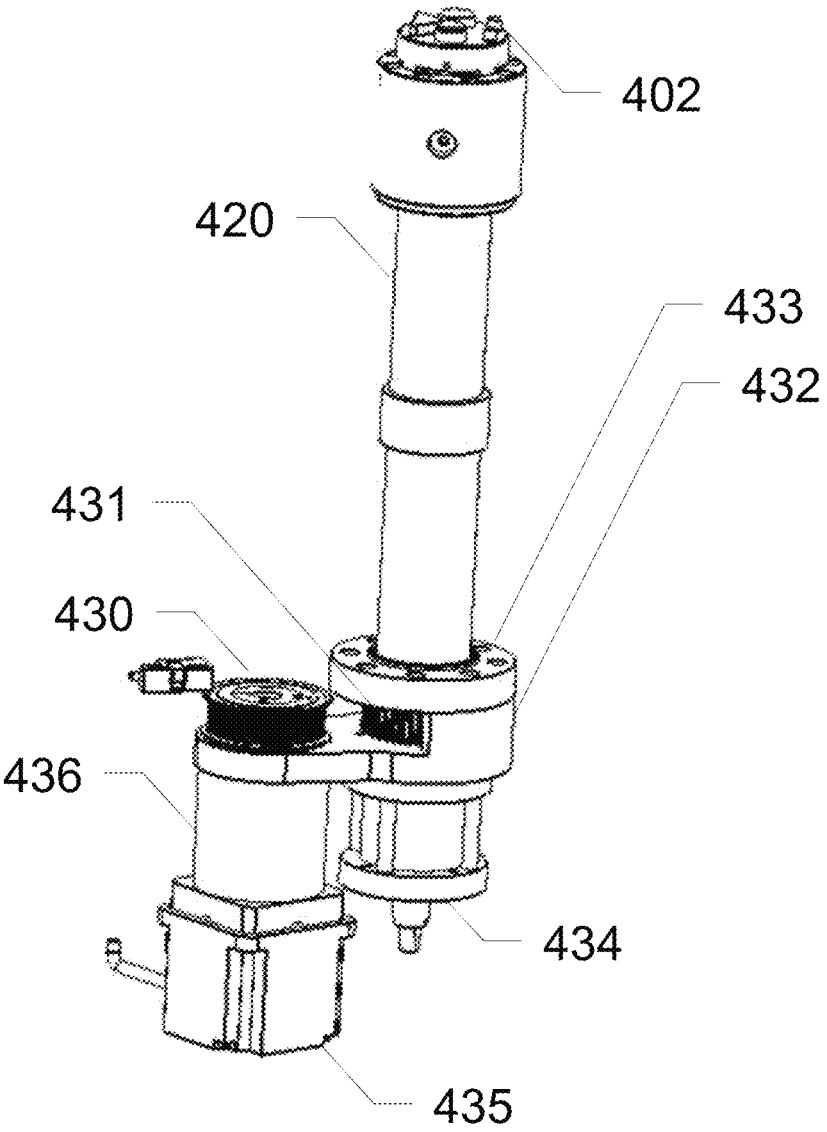
FIG. 4A shows a turret assembly, according to an exemplary embodiment of the present invention.

FIG. 4A shows a turret assembly comprising a turret cluster 402, a turret shaft 420, a turret driver pulley 430, a turret driven pulley 431, turret support shell 432, a turret cylinder 434, a turret motor 435, and a turret gearbox 436, according to an exemplary embodiment of the present invention. Turret shaft 420 has the same function as shaft 320 from FIG. 3. In this exemplary embodiment, the shaft is longer so that it extends through the machinery discussed herein below. Turret shaft 420 has a square cross-sectional area at the bottom where turret driven pulley 431 surrounds turret shaft 420. Just above the square portion is a cylindrical portion with a smaller diameter than the rest of turret shaft 420 and a height substantially the same as the square portion. Turret driven pulley 431 has an inner aperture that is square shaped to match turret shaft 420. The union of turret shaft 420 and turret driven pulley 431 is such that they rotate in unison. Turret driven pulley 431 is accompanied by two bearings 437, one on either side, shown in FIG. 4B. Turret driven pulley 431, accompanying bearings 437, and turret driver pulley 430, are all within turret support shell 432. Turret support shell 432 is one of the few stationary parts of the turret assembly. Every motion of the turret can be said with respect to turret support shell 432, which does not move relative to the entire bending head. Turret support shell 432 includes a shell disc 433 which surrounds turret shaft 420 and has a square shaped aperture identical to the inner aperture of turret driven pulley 431. Turret support shell 437 holds both turret driver pulley 430 and turret driven pulley 431 in relative position while allowing them to spin. Below turret driver pulley 430 is turret gearbox 436 and turret motor 435 Below turret driven pulley is turret cylinder 434.

Figure 4B:
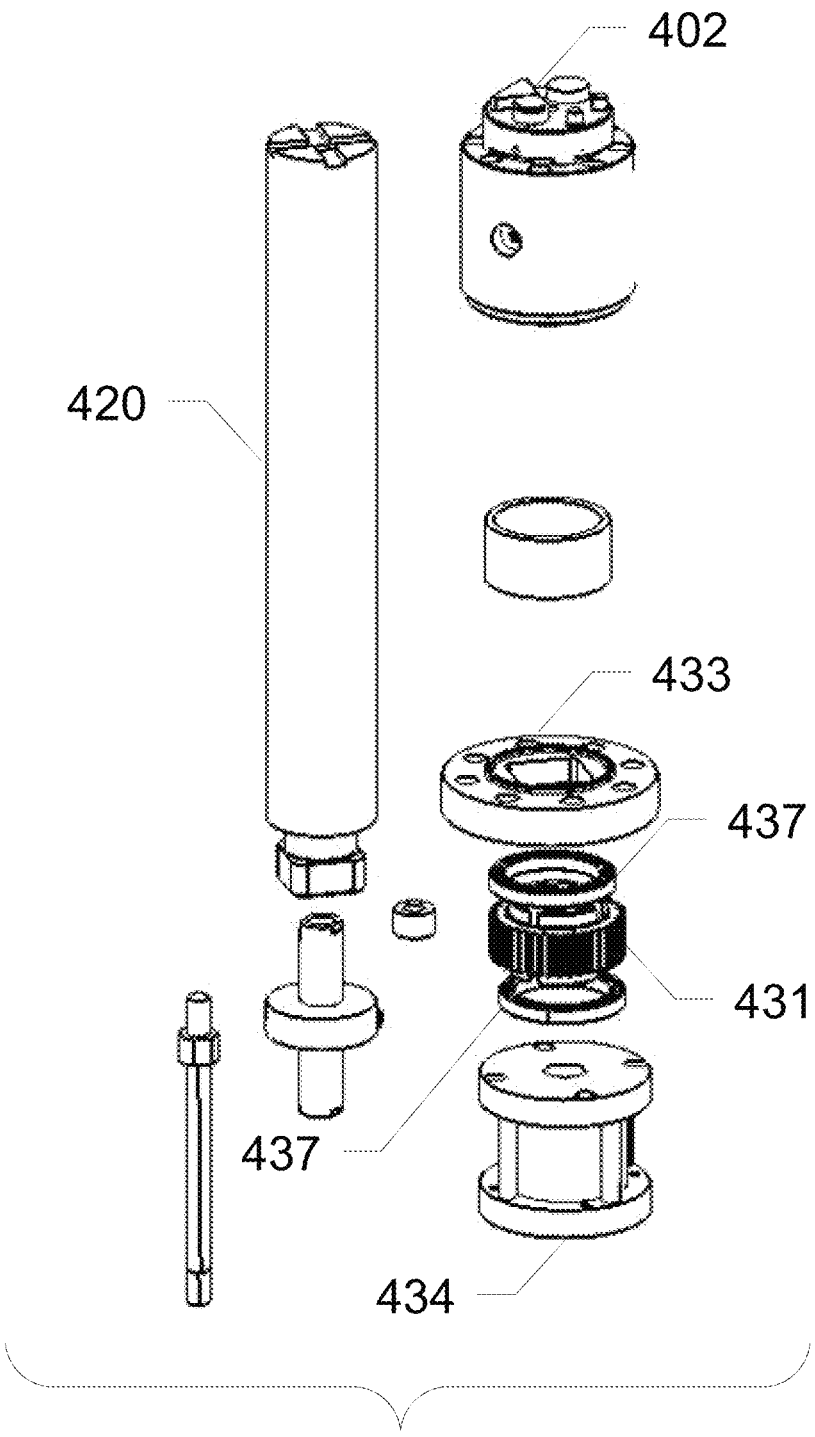
FIG. 4B shows an exploded view of the components used in the elevation change of the turret cluster, according to an exemplary embodiment of the present invention.

Turret cylinder 434 is the driving force behind elevation change in turret cluster 402. FIG. 4B shows the components used in the elevation change, according to an exemplary embodiment of the present invention. Cylinder 434 is a pneumatic elevator which lifts the turret assembly from turret shaft 420 up, and lowers the turret assembly as well. When turret shaft 420 is raised, turret cluster 402 engages with the wire in a position for bending. When turret shaft 420 is lowered, turret cluster disengages with the wire allowing it to rotate into a different orientation without manipulating the wire. In a raised position, the square portion of turret shaft 420 is within shell disc 433. Since shell disc 433 is stationary, turret shaft 420 and turret cluster 402 are in a fixed orientation and do not rotate. In a lowered position, the square portion of turret shaft 420 is within turret driven pulley 431, leaving the portion of turret shaft 420 with a smaller diameter within shell disc 431. This portion has a diameter sized such that it can fit within and freely rotate within the square-shaped aperture of shell disc 433. In this lowered position, the shaft may rotate into one of four orientations, and is raised again. The four orientations are consistent with the square shape of the shaft and apertures. Shell disc 433 is held stationary, and turret shaft 420 can only be raised into shell disc 433 in one of four orientations.

Alternate embodiments of the turret assembly comprise forms of elevation other than pneumatic such as an electric solenoid or an added gear or pulley assembly. These and other forms will be readily recognizable to those having skill in the art. Those having skill in the art will also recognize that different shapes of the turret shaft and the aperture of the shell disc will yield different possible orientations and in some cases exceeding four orientations. For example, the shell disc aperture can be modified to have an eight-point star shape consistent with the shape created by placing two squares on top of each other, then rotating one square forty-five degrees (45°), as shown in FIG. 4C. In this embodiment, the turret shaft and the turret driven pulley aperture can remain square while the modified shell disc aperture can accommodate eight different orientations.

Turret motor 435 is the driving force behind the rotation of the turret. FIG. 4D shows the components used in rotation of turret shaft 420, according to an exemplary embodiment of the present invention. Turret motor 435 generates motion that is translated by turret gearbox 436 to the proper power and torque to exert upon turret driver pulley 430. A belt tightly surrounds turret driver pulley 430 and turret driven pulley 431 so that angular motion of turret driver pulley 430 causes angular motion of turret driven pulley 431. This motion is used to orient turret cluster 402 when turret shaft 420 is in a lowered position before it is raised again to engage the wire. While in a raised position turret driven pulley 431 may freely rotate without affecting the orientation of turret shaft 420. As such, turret motor 435 only requires power when turret shaft 420 is in a lowered position.

The turret motor produces an output that not only rotates the turret assembly, but does it quickly. A simple wire design can take about five seconds to produce from start to the final cut. In order to achieve this kind of speed, every motion within the bending head must be as quick as is efficiently possible. The belt used to transfer the angular motion from the turret drive pulley to the turret driven pulley is made from a flexible, yet strong and durable material such as rubber or comparable material. Alternately, the turret driven pulley and turret drive pulley can be replaced with two gears rendering the belt unnecessary. Using the belt, however, can reduce noise, help shock absorption due to load fluctuations, and does not require lubricant. Other methods of rotating the turret assembly will be readily recognizable to those having skill in the art.

Figure 5A:
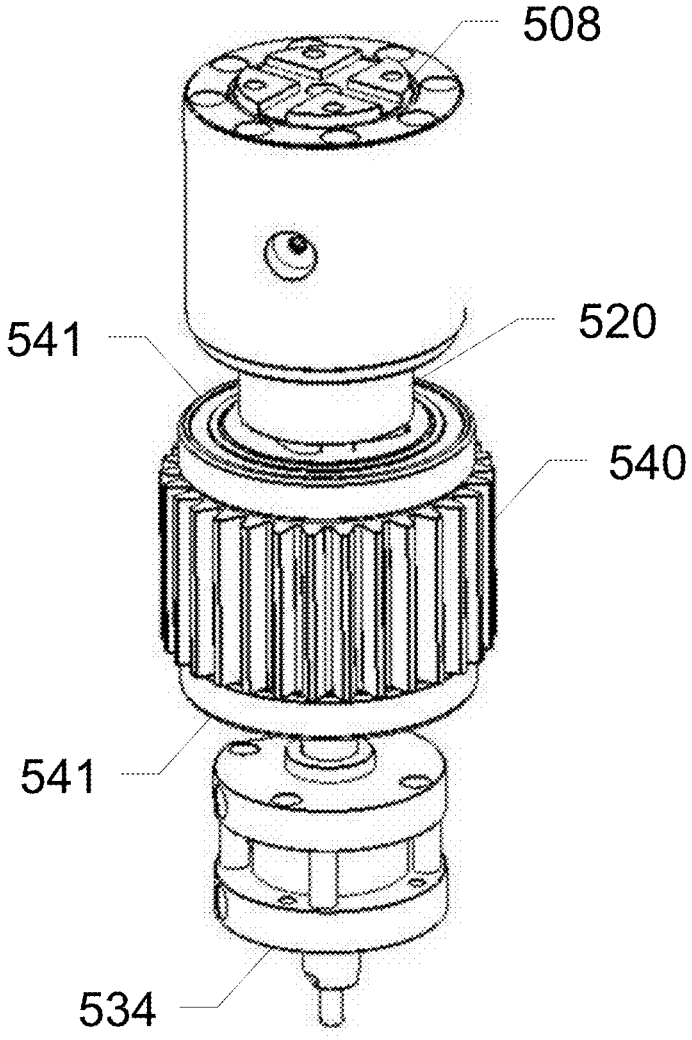
FIG. 5A shows a nose or mandrel bender assembly, according to an exemplary embodiment of the present invention.

FIG. 5A shows a mandrel assembly comprising a tool connector 508, a shaft 520, and a cylinder 534, according to an exemplary embodiment of the present invention. Tool connector 508 is fixed to the end of shaft 520, which is surrounded by a planetary gear 540 at the square-shaped portion of shaft 520 also shown in FIG. 3. Planetary gear 540 has an inner aperture that is square shaped to match the turret shaft. The union of shaft 520 and planetary gear 540 is such that they rotate in unison. Planetary gear 540 is accompanied by two bearings 541, one on either side. Cylinder 534 sits below shaft 520.

Figure 5B:
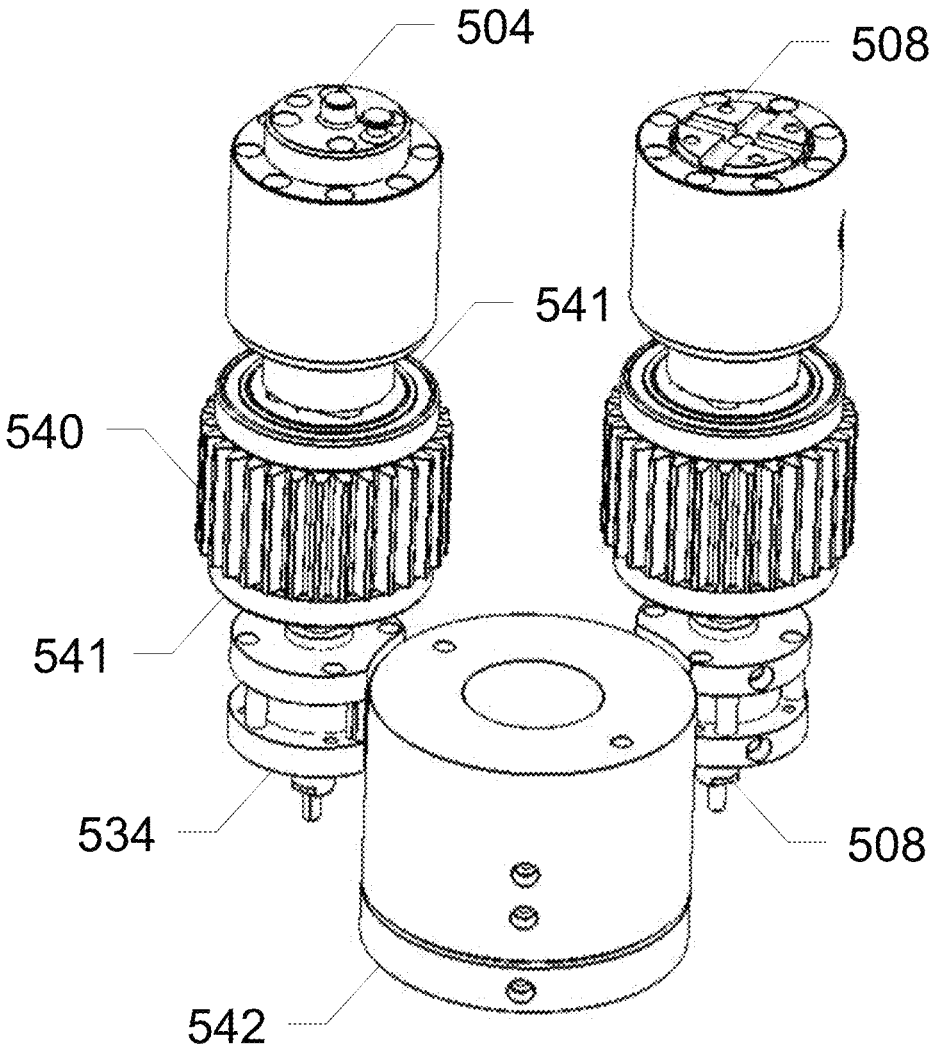
FIG. 5B shows a mandrel and blank bender assemblies alongside of a rotary union, according to an exemplary embodiment of the present invention.

Cylinder 534 is responsible for raising and lowering shaft 520 in order to engage or disengage the wire. FIG. 5B shows a mandrel-bending mandrel assembly and a blank mandrel assembly alongside of a rotary union 542, according to an exemplary embodiment of the present invention. Rotary union 542 is a device used to distribute pneumatic force to freely revolving nose and mandrel bending head assemblies. Rotary union 542, though stationary itself with respect to the bending head, delivers pneumatic pressure to cylinders 534 when the cylinders 534 are in a proper position about rotary union 542. In one of a few proper positions, the holes on the outside of rotary union 542 align with holes on the inside of cylinders 534. The inside portion of cylinders 534 are curved inward to match the outer curvature of rotary union 542. Cylinders 534 and rotary union 542 are in contact with each other at every point in the revolution of cylinders 534. This design yields three positions where the holes align to raise and lower shaft 520, but those skilled in the art will readily recognize designs yielding more or less positions. Also, the positions are only critical for elevation change. Each mandrel or nose bending head assembly can rotate fully in a raised or lowered position, and only returns to one of the three positions to change elevation.

The rotary union is designed with a throughbore having a diameter just larger than the turret shaft. This allows the turret shaft to run through the center of the rotary union and spin unimpeded by the presence of the rotary union. The rotary union, however, does not spin at all, and is fixed relative to the bending head. This form of pneumatic distribution relieves the necessity for hoses and allows the mandrels to revolve infinitely around the turret cluster. Alternate embodiments of the mandrel assembly comprise forms of elevation other than pneumatic such as an electric solenoid or an added gear or pulley assembly. These and other forms will be readily recognizable to those having skill in the art.

Additionally, each nose or mandrel bending head may rotate around a point at a fixed distance from the turret cluster. In exemplary embodiments of the present invention, the nose and mandrel bending tools coupled to a bending head are geared together, such that each rotates at the same time using the same drive.

Figure 6A:
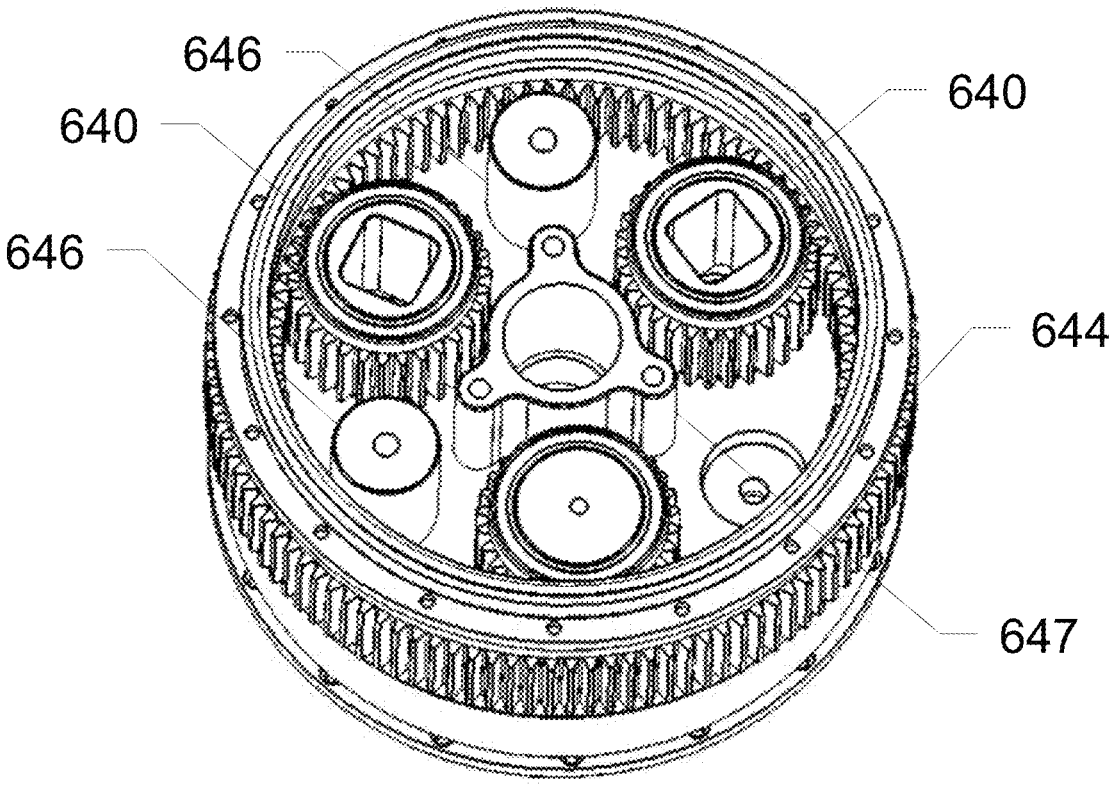
FIG. 6A shows a planetary or epicyclic gear system, according to an exemplary embodiment of the present invention.

FIG. 6A shows a planetary or epicyclic gear system having an outer gear or annulus 644, and three planetary gears 640, each planetary gear 640 being part of a mandrel assembly, according to an exemplary embodiment of the present invention. The planetary gear system is responsible for the rotation of the planetary gears only. The revolution of the planetary gears around the turret cluster is described hereinafter in FIGS. 7A and 7B. Annulus 644 rotates independently of the revolution of planetary gears 640. When annulus 644 rotates, it rotates each planetary gear 640 in position, but the planetary gears 640 do not change position while rotating due to the rotation of annulus 644. Planetary gears 640 all rotate in unison. When annulus 644 rotates, every planetary gear 640 rotates. Also shown in FIG. 6A are support posts 646 and center support 647. These supports aid in holding everything within annulus 644 together and will be explained in further detail below.

In other embodiments, the pneumatic cylinders can incorporate a third elevation where the planetary gears do not match with the annulus enabling rotation of individual planetary gears. The annulus can be formed with a smooth portion where, at a certain elevation, the planetary gears are free from the teeth of the annulus allowing the annulus to rotate without rotating the mandrels. In further embodiments, each mandrel or nose bending assembly can incorporate its own rotational motor, as with the turret motor While each motor may last longer in these embodiments, the bending head becomes heavier and the load on the bending rotator assembly, explained hereinafter, becomes larger which can wear out the bending motor faster.

Figure 6B:
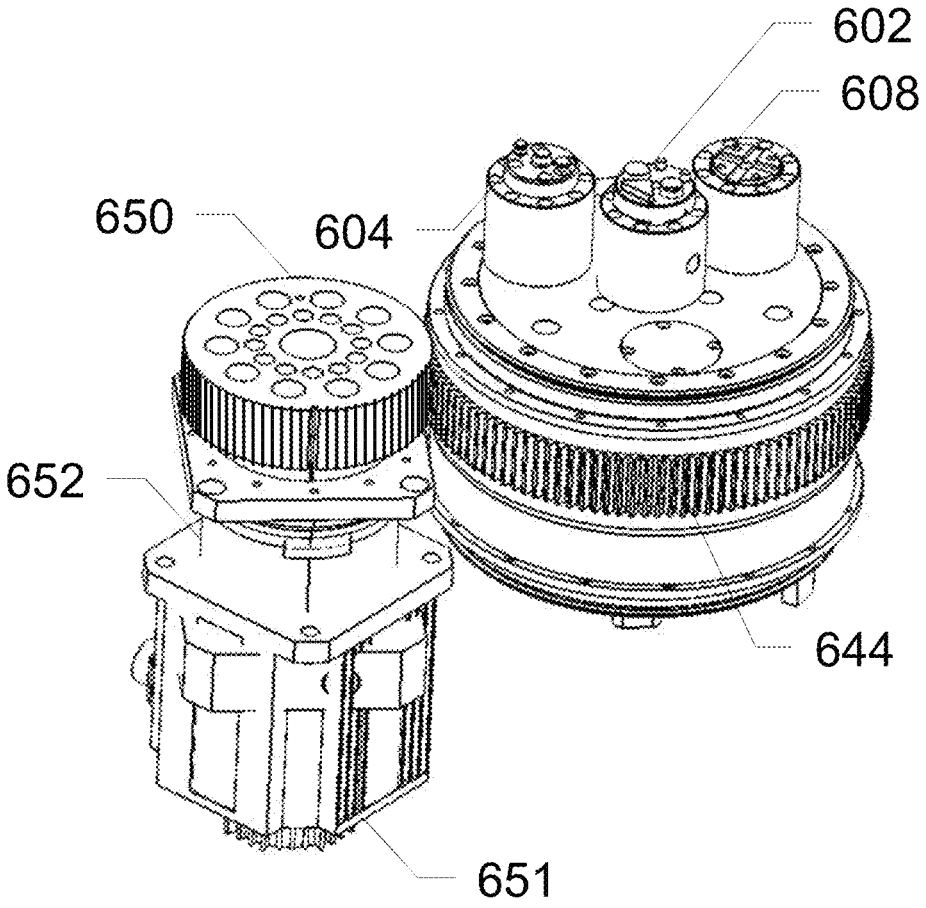
FIG. 6B shows a mandrel rotator assembly, according to an exemplary embodiment of the present invention.
Figure 6C:
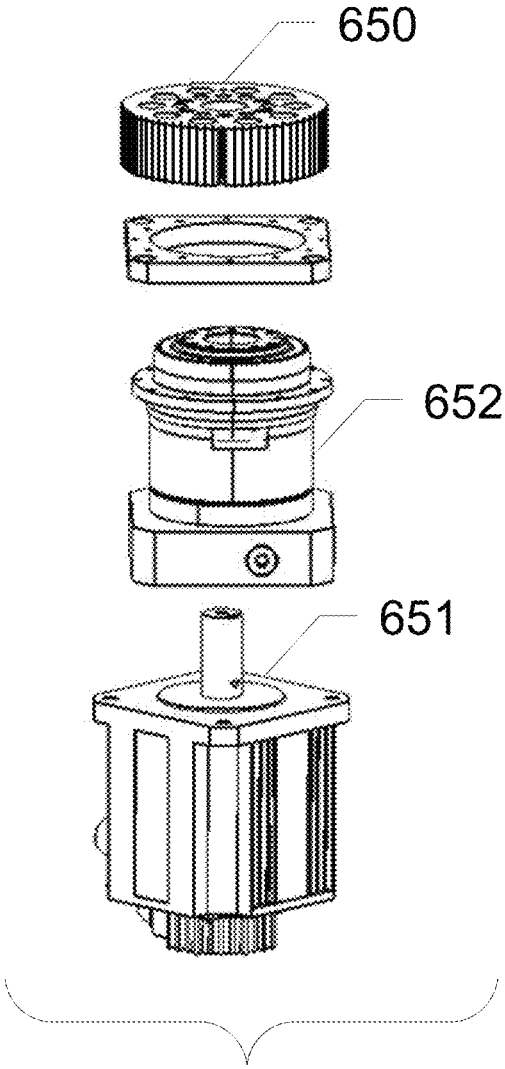
FIG. 6C shows an exploded partial view of a mandrel rotator assembly, according to an exemplary embodiment of the present invention.

Planetary gear 640 works with the planetary or epicyclic gear system to rotate each mandrel. FIG. 6B shows a mandrel rotator assembly having an outer gear or annulus 644, a mandrel pinion 650, a mandrel motor 651, and a mandrel gear box 652, according to an exemplary embodiment of the present invention. Turret cluster 602, mandrel-bending mandrel 604, and blank mandrel 608 are above annulus 644. Annulus 644 is rotated by mandrel pinion 650 which is powered by mandrel motor 651 through mandrel gear box 652. Mandrel motor 651 and mandrel gear box 652 perform substantially the same function as turret motor 435 and turret gear box 436 of FIG. 4D. Mandrel motor 651 is preferably larger with more power output than turret motor 435, because the load is larger. FIG. 6C shows an exploded partial view of the mandrel rotator assembly. Mandrel motor 651 forces rotation of mandrel pinion 650 through mandrel gear box 652.

In alternate exemplary embodiments, the mandrel pinion is replaced with a mandrel drive pulley. In these embodiments, the annulus does not have teeth on the outside of the ring, but has a belt wrapped around it and the mandrel drive pulley. The annulus retains its inner teeth, however, to rotate each planetary gear. These embodiments are not capable of delivering as much power to mandrel rotation as with the mandrel pinion. Mandrel rotation requires a lot of power, however, since mandrel rotation is often the process that actually bends a wire. During a mandrel bend, for instance, a wire is bent completely around the center pin. This motion needs to have enough power not only to complete the full bend, but to do it quickly.

Figure 7A:
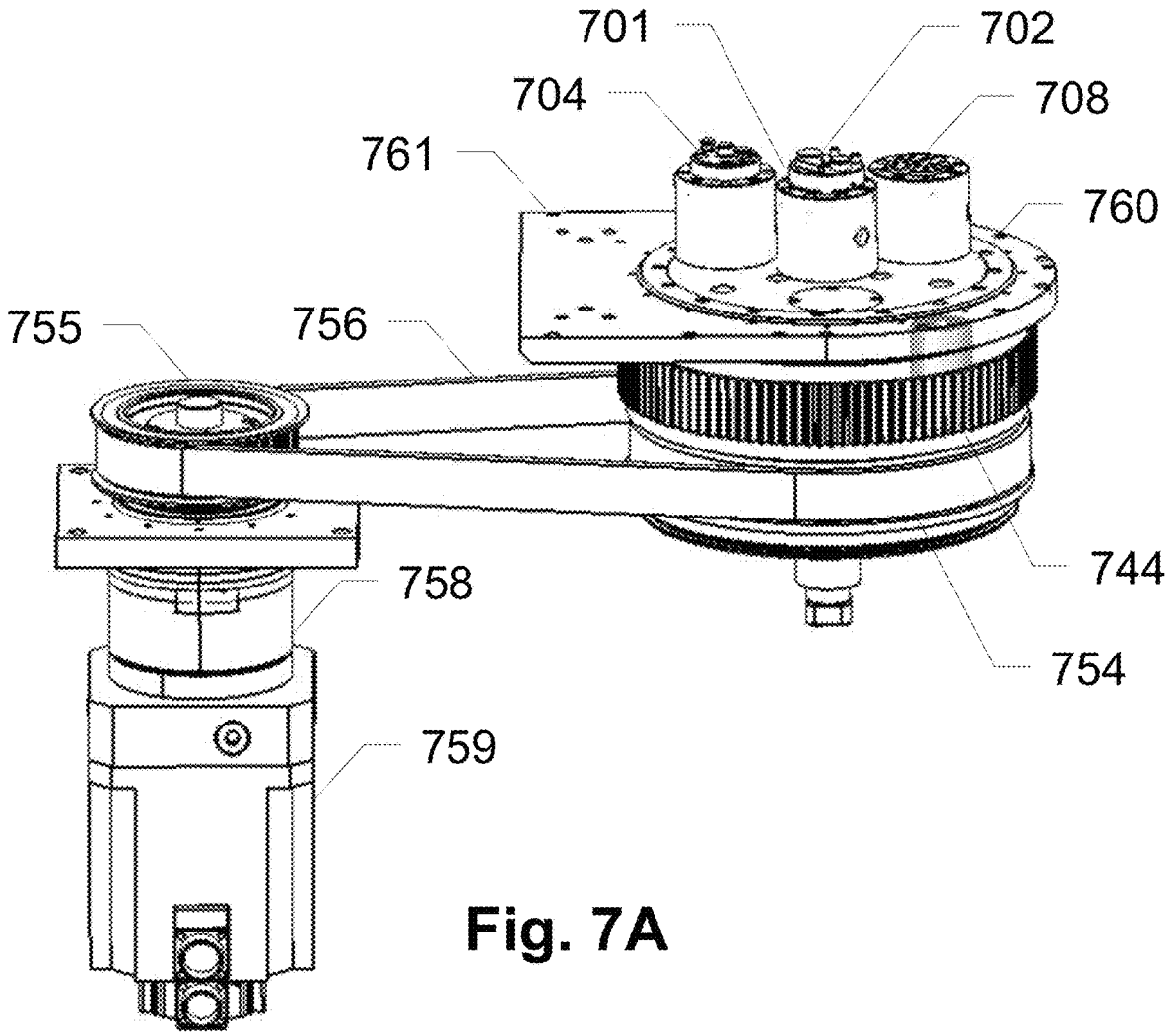
FIG. 7A shows a bending rotator assembly, according to an exemplary embodiment of the present invention.
Figure 7B:
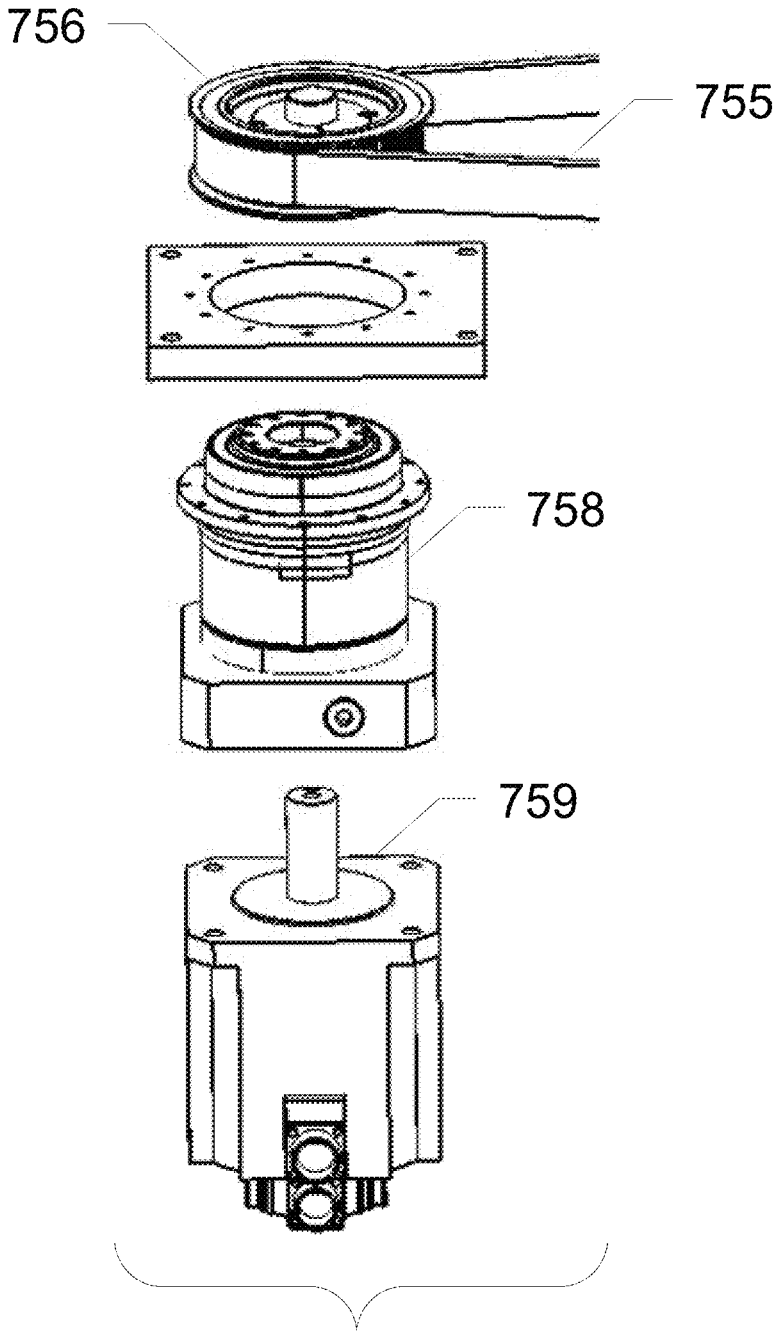
FIG. 7B shows an exploded partial view of a bending rotator assembly, according to an exemplary embodiment of the present invention.

FIG. 7A shows a bending rotator assembly having a bending assembly 701, a bending driven pulley 754, a bending driver pulley 755, a bending belt 756, a bending gear box 758, and a bending motor 759, according to an exemplary embodiment of the present invention. Bending assembly 701 features turret cluster 702, mandrel-bending and blank mandrels 704 and 708, respectively, rotating plate 760, stationary plate 761, and the planetary gear system featuring annulus 744 below the plates. Below the planetary gear system is bending driven pulley 754, which rotates the whole bending assembly including rotating plate 760, but not stationary plate 761. Bending belt 756 wraps around bending driven pulley 754 and bending driver pulley 755. When bending driver pulley 755 rotates, bending belt 756 translates the angular motion to bending driven pulley 754. Bending driver pulley 755 is turned by bending motor 759 through bending gear box 758. Bending motor 759 and bending gear box 758 operate in substantially the same manner as mandrel motor 651 and mandrel gear box 652 of FIG. 6, and turret motor 435 and turret gear box 436 of FIG. 4. Bending motor 759 is ideally the largest of the three motors because its load is the largest. FIG. 7B shows an exploded partial view of the bending rotator assembly. Bending motor 759 forces rotation of bending drive pulley 755 through bending gear box 758.

Figure 7C:
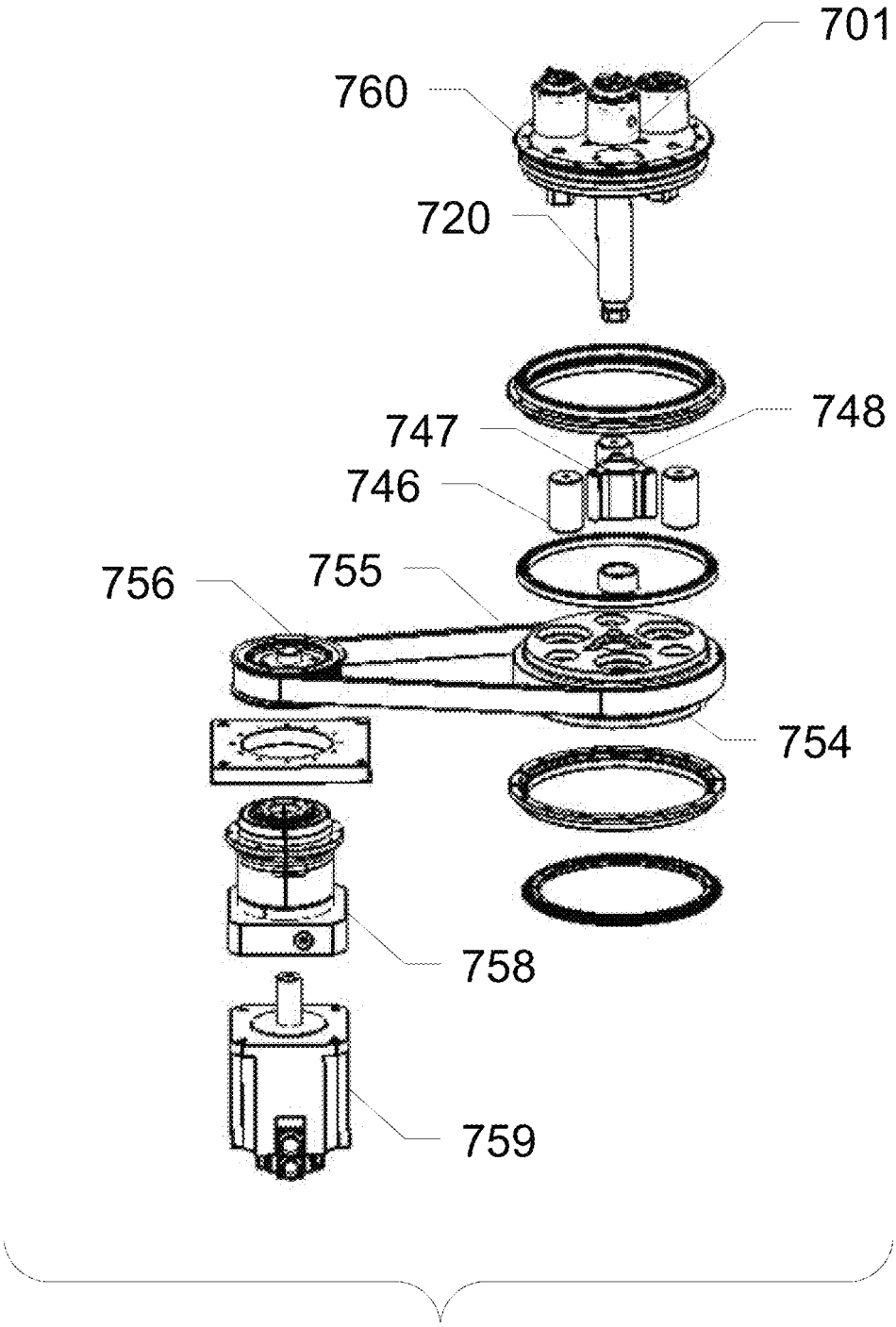
FIG. 7C shows an exploded view of a bending rotator assembly, according to an exemplary embodiment of the present invention.

FIG. 7C shows an exploded view of the bending rotator assembly according to an exemplary embodiment of the present invention. Bending assembly 701, comprising mandrel-bending and blank mandrels 704 and 708, respectively, turret cluster 702, and rotating plate 760, rests above support posts 746 and center support 747. Bending driven pulley 754 is fastened underneath support posts 746 and center support 747. Center support 747 has a large throughbore 748 to receive turret shaft 720 which extends through bending driven pulley 754 as well. Bending assembly 701, support posts 746, center support 747, and the mandrel assemblies all rotate in unison upon power by bending motor 759. Since the mandrels need to rotate independently they cannot fixedly attach bending driven pulley 754 to rotating plate 760. This fixed attaching is accomplished instead by support posts 746 and center support 747, which ensure bending driven pulley 754 and rotating plate 760 rotate in unison even under heavy load.

The center support and supports posts are just one of many ways to secure the bending driven pulley to the rotating plate. In exemplary embodiments having more than three mandrels, the support posts may need to be smaller to fit between each mandrel. Alternately, the center support may have protrusions stemming radially outward wherein each protrusion is in between mandrels. As with the other motors, a pinion and gear assembly can be used in other exemplary embodiments instead of the pulley system. While the bending pulley is responsible for rotating the entire bending driven plate, mandrels, supports, and rotating plate, it is rarely responsible for the actual bending of wire. When the bending motor revolves the mandrels around the turret cluster, it is more often for repositioning of the mandrels than actual wire bending. Thus, the load is consistent and a belt can be designed to accommodate that load. Using the pulley embodiments allows for quieter operation and no lubricant is required.

Figure 8:
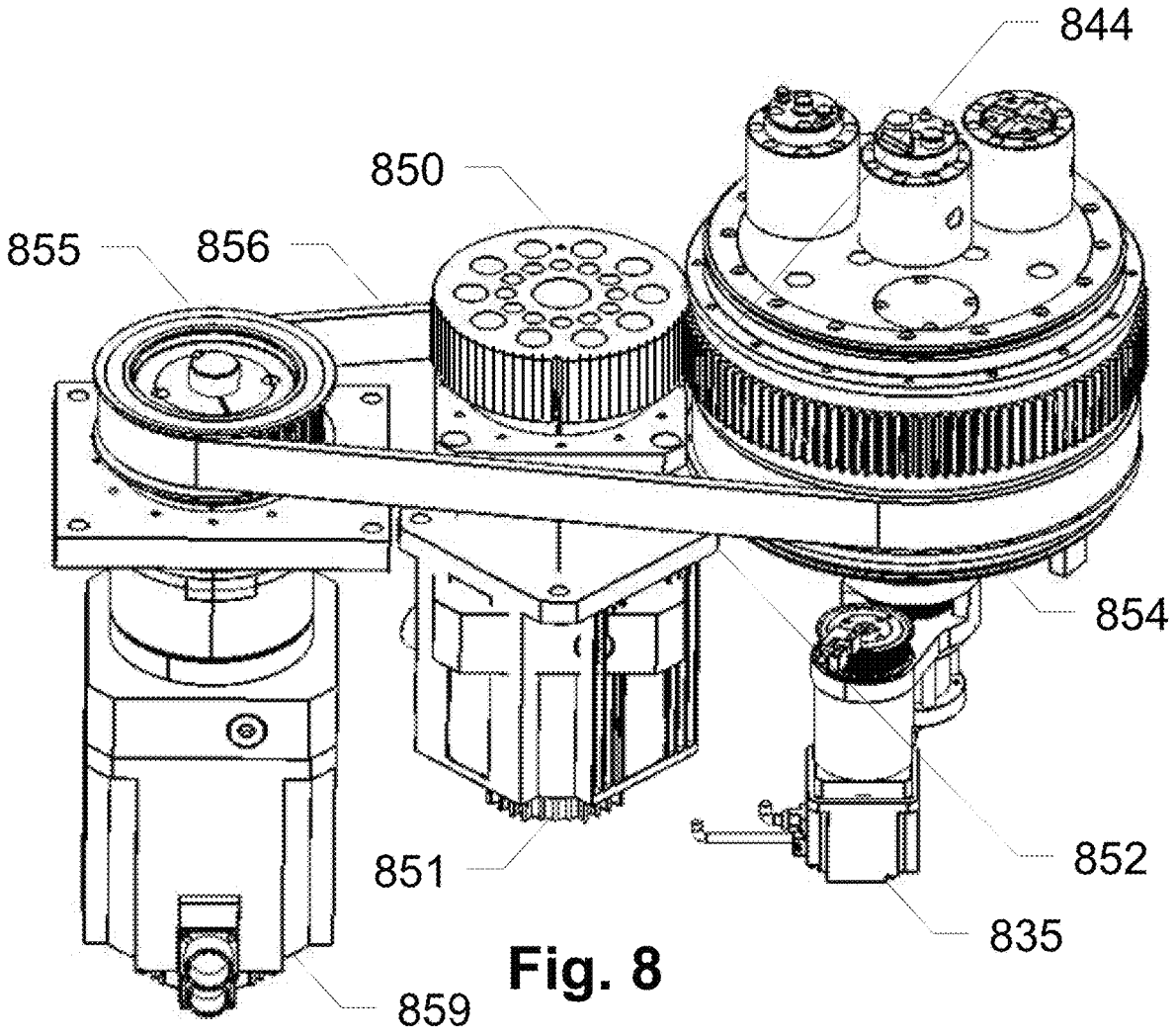
FIG. 8 shows the major components of the bending head assembly, according to an exemplary embodiment of the present invention.

FIG. 8 shows the major components of the bending head assembly including the turret assembly as in FIG. 4A, the mandrel-bending and nose-bending mandrel assemblies as in FIG. 5A, the mandrel rotator assembly as in FIG. 6B, and the bending rotator assembly as in FIG. 7A interconnected, according to an exemplary embodiment of the present invention. Many different configurations of the major components will be readily recognizable to those having skill in the art. Turret motor 835 is below the turret assembly out of the way of the mandrel assemblies and the rotary union. Mandrel pinion 850 must be adjacent to annulus 844 since these are geared together instead of a pulley system, but bending motor 859 can be spaced farther away since bending belt 856 can link bending drive pulley 855 to bending driven pulley 854. Mandrel motor 851, mandrel gear box 852, and mandrel pinion 850 fit conveniently inside bending belt 856 between bending drive pulley 855 and bending driven pulley 854.

Figure 9A:
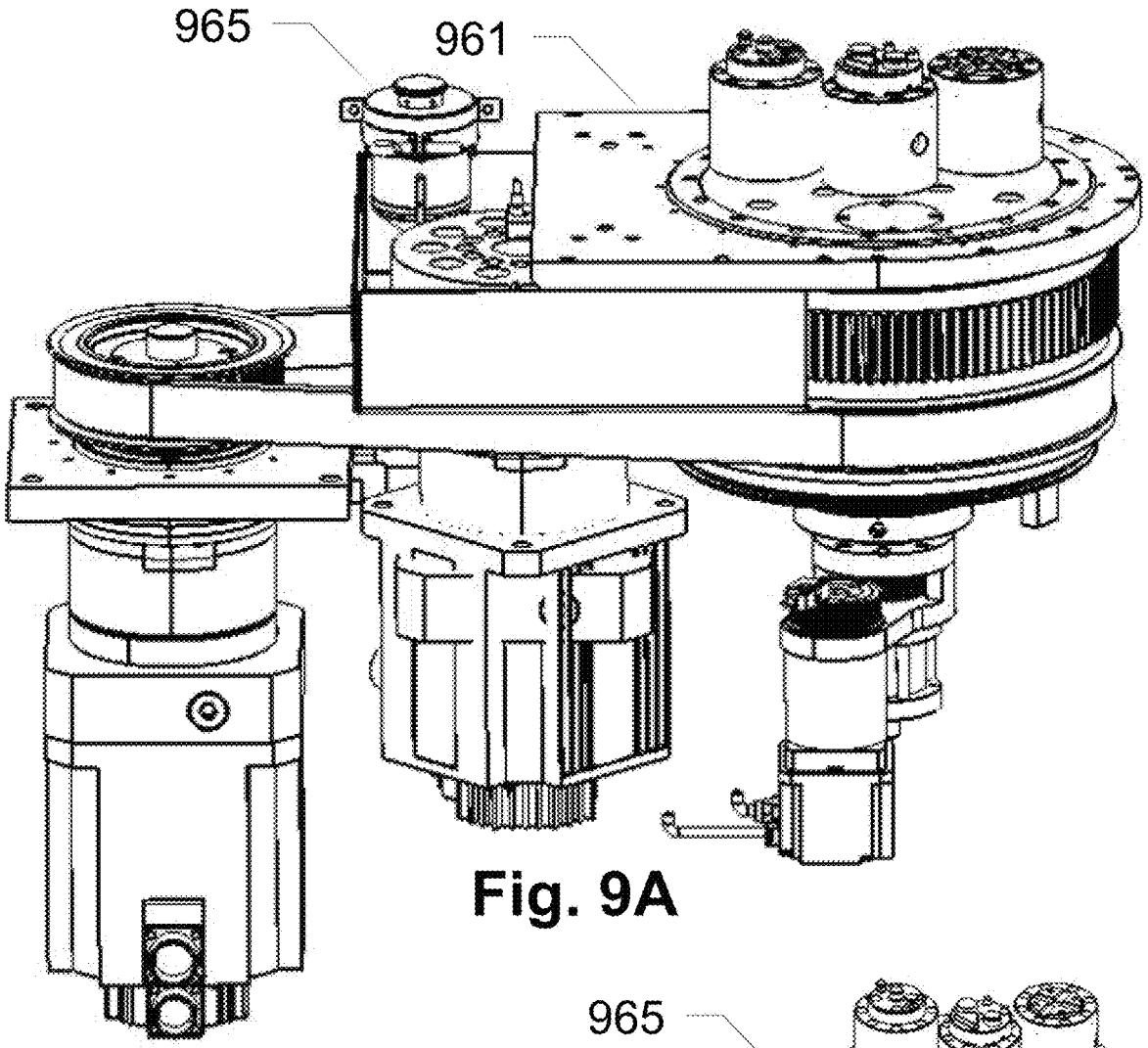
FIG. 9A shows the major components of the bending head assembly with the addition of a stationary plate, according to an exemplary embodiment of the present invention.
Figure 9B:
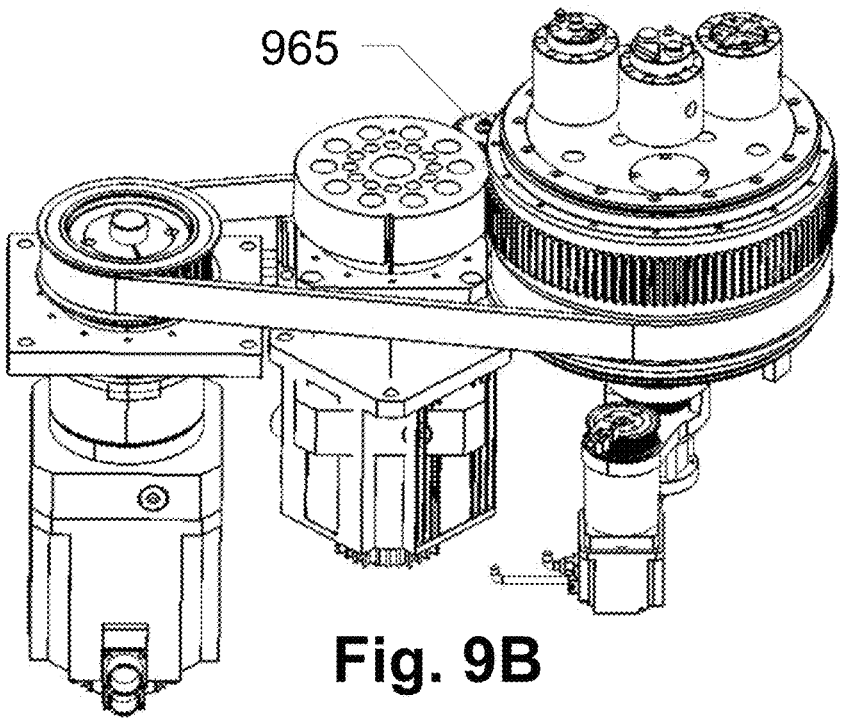
FIG. 9B shows a lubricating pinion, according to an exemplary embodiment of the present invention.

FIG. 9A shows the major components of the bending head assembly as in FIG. 8, with the addition of a stationary plate 961 and a lubrication unit 964, according to an exemplary embodiment of the present invention. Lubrication unit 964 holds lubricant which is dispersed through a lubricating pinion 965. FIG. 9B does not show stationary plate 961 in order to show a lubricating pinion 965. Those having skill in the art will readily recognize many variations of lubrication techniques.

Since the pulley systems do not require lubrication, the lubricating pinion does not need to distribute lubrication to very many components. In alternate embodiments the annulus contains small holes allowing the lubricant to seep through to the inside of the annulus where it can lubricate the planetary gears.

Figure 10A:
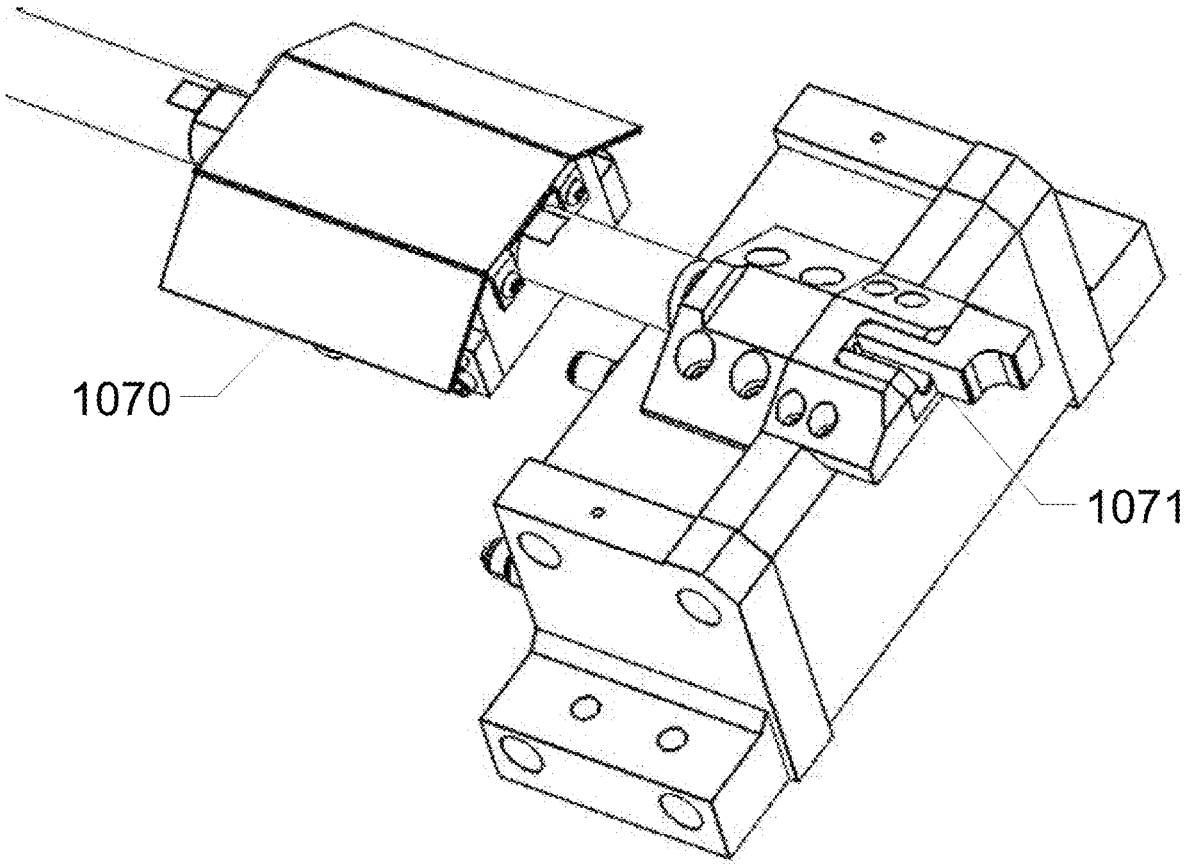
FIG. 10A shows a wire feeding and cutting assembly, according to an exemplary embodiment of the present invention.
Figure 10B:
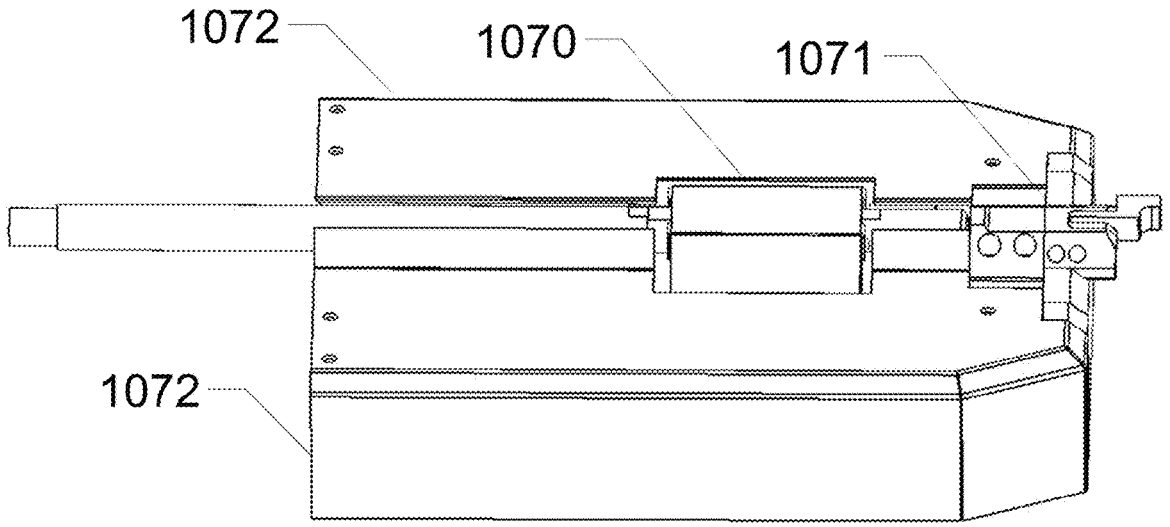
FIG. 10B shows the wire feeding and cutting assembly with two protective panels, according to an exemplary embodiment of the present invention.

FIG. 10A shows a wire feeding and cutting assembly having a wire feeder 1070 and a wire cutter 1071. Wire feeder 1070 pulls wire from a source, such as a spool of wire, and threads it into the bending head. The wire is fed into the center of the bending head where the turret cluster, mandrel bending head, and nose bending head can manipulate it. The wire is manipulated as it is fed through the bending head. Wire feeder 1070 can feed wire forward or backward so there is no need to make bends in order from the first end of the wire to the second, but it aids efficiency. Once the bending head has made all necessary bends in a wire, the wire is cut by wire cutter 1071. The cut wire is in many cases released, but can be held in place for further bending as in a double loop wire explained hereinafter. FIG. 10B shows the wire feeding and cutting assembly with protective panels 1072.

These exemplary embodiments can accommodate a range of wire cutting and feeding assemblies. Other wire cutting and feeding assemblies compatible with these embodiments will be readily recognizable by those having skill in the art.

Figure 11:
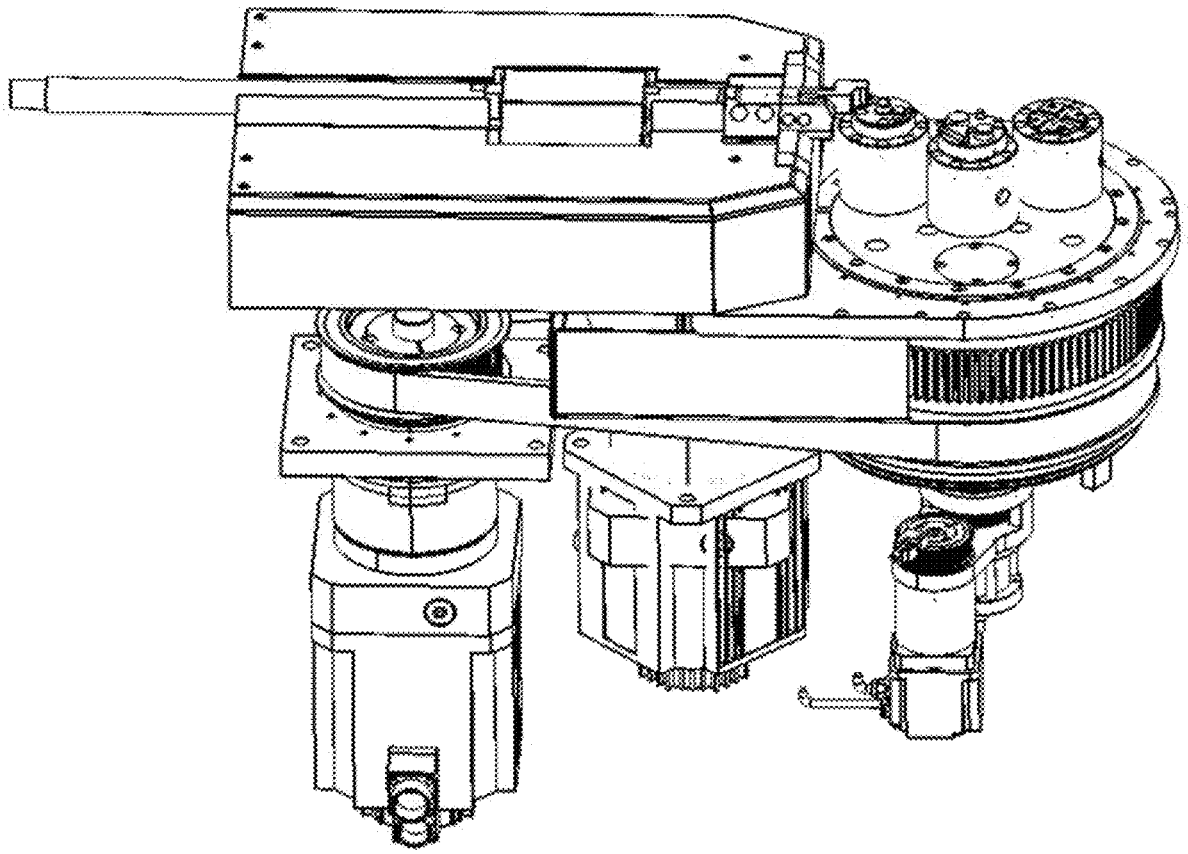
FIG. 11 shows the major components of the bending head assembly together with the wire feeding and cutting assembly, according to an exemplary embodiment of the present invention.

FIG. 11 shows the major components of the bending head assembly together with the wire feeding and cutting assembly, according to an exemplary embodiment of the present invention. The protective panels of the wire cutting and feeding assembly help shield other components such as the mandrel pinion in this configuration. Other configurations will be readily recognizable to those having skill in the art.

Figure 12:
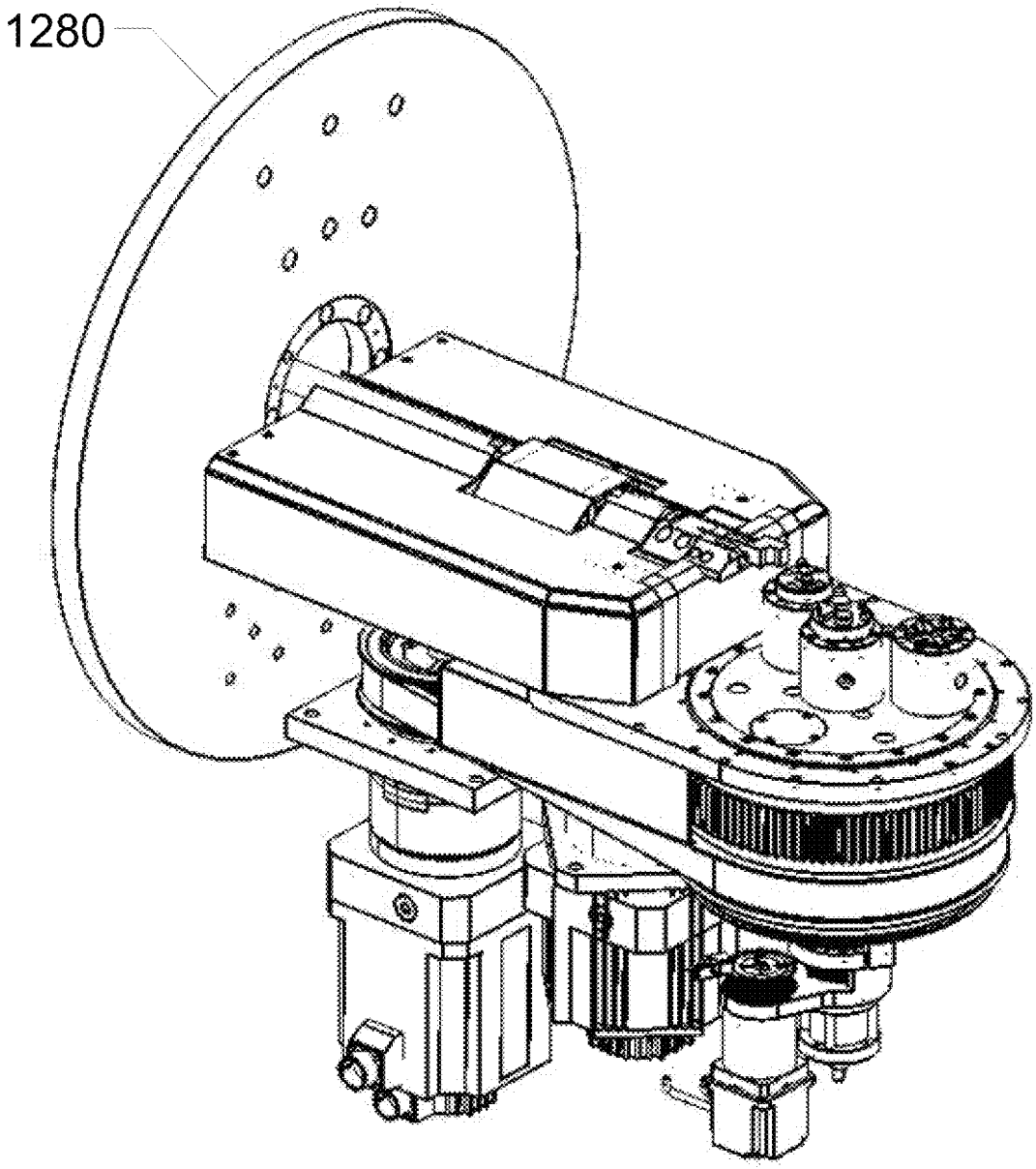
FIG. 12 shows the major components of the bending head assembly together with the wire feeding and cutting assembly and a mounting plate, according to an exemplary embodiment of the present invention.

FIG. 12 shows the major components of the bending head assembly together with the wire feeding and cutting assembly and a mounting plate 1280, according to an exemplary embodiment of the present invention. Mounting plate 1280 attaches to the entire bending head on one face and attaches to, for example, the rest of a CNC wire bending machine. When bending wire, bends occur at different angles. In order to change the angle of a bend one of two things must be rotated: either the wire itself, or the bending head. Rotating the wire can cause problems of generating unnecessary internal stress on the wire, so instead the entire bending head is rotated around the wire itself. Mounting plate 1280 is the mount in which the bending head rotates around. The wire is fed through the center of mounting plate 1280 so that the wire is in the center point about which the bending head rotates.

Figure 13:
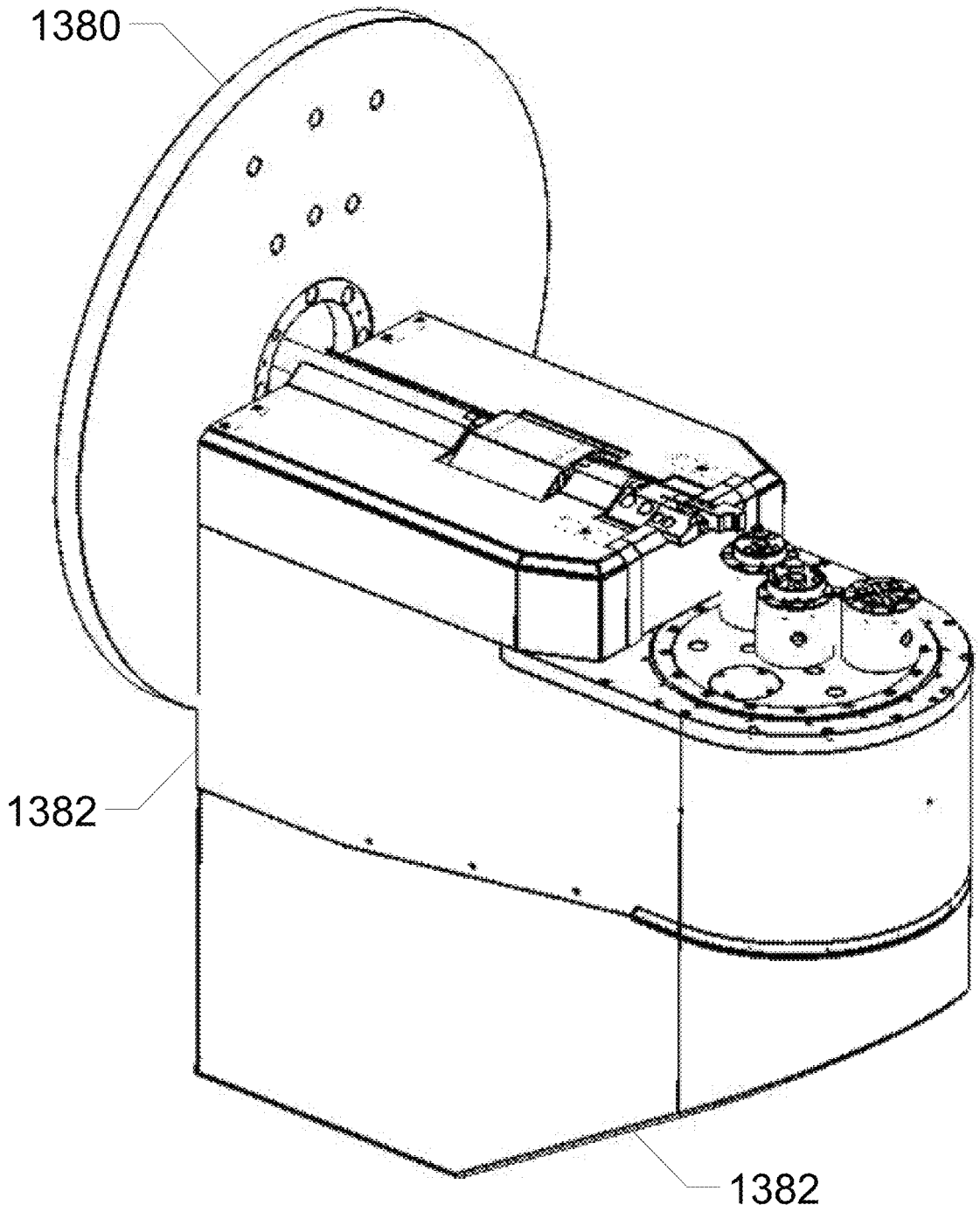
FIG. 13 shows the bending head assembly together with the wire feeding and cutting assembly, mounting plate 1380, and a plurality of body panels, according to an exemplary embodiment of the present invention.

FIG. 13 shows the bending head assembly together with the wire feeding and cutting assembly, mounting plate 1380, and a plurality of body panels 1382, according to an exemplary embodiment of the present invention. Body panels 1382 are not load bearing and are some of the few parts in the bending head assembly that do not need to be made of metal or material of comparable strength. Body panels 1382 keep dust out of the assembly as well as provide a cover for the bending head assembly.

The next figures show the steps for creating a wire with complete loops at each end, according to an exemplary embodiment of the present invention. A nose bend is performed on the first end of the wire just before the following mandrel bend. The mandrel bend forms a complete loop at the first end. Next, the wire is fed through the center line and cut to form a second end of the wire. The second end of the wire is then mandrel bent to form a complete loop at the second end. This is an example of how the wire is cut before all bends have been made.

Figure 14:
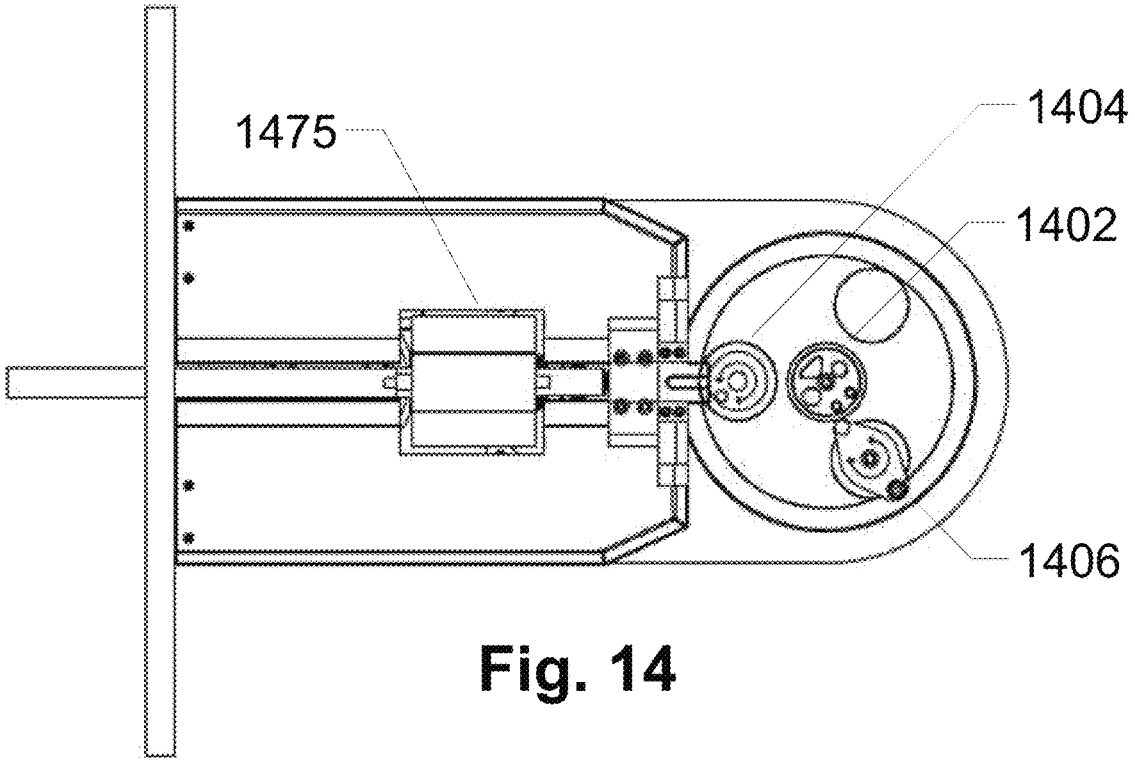
FIG. 14 shows a top view of a bending head assembly, according to an exemplary embodiment of the present invention.

FIG. 14 shows a top view of a bending head assembly having a turret cluster 1402, a mandrel-bending mandrel 1404, a nose-bending mandrel 1406, and a wire feeding and cutting assembly 1475, according to an exemplary embodiment of the present invention. The following seven figures show incremental steps in forming a double end-loop wire using this exemplary embodiment of the present invention.

Figure 15:
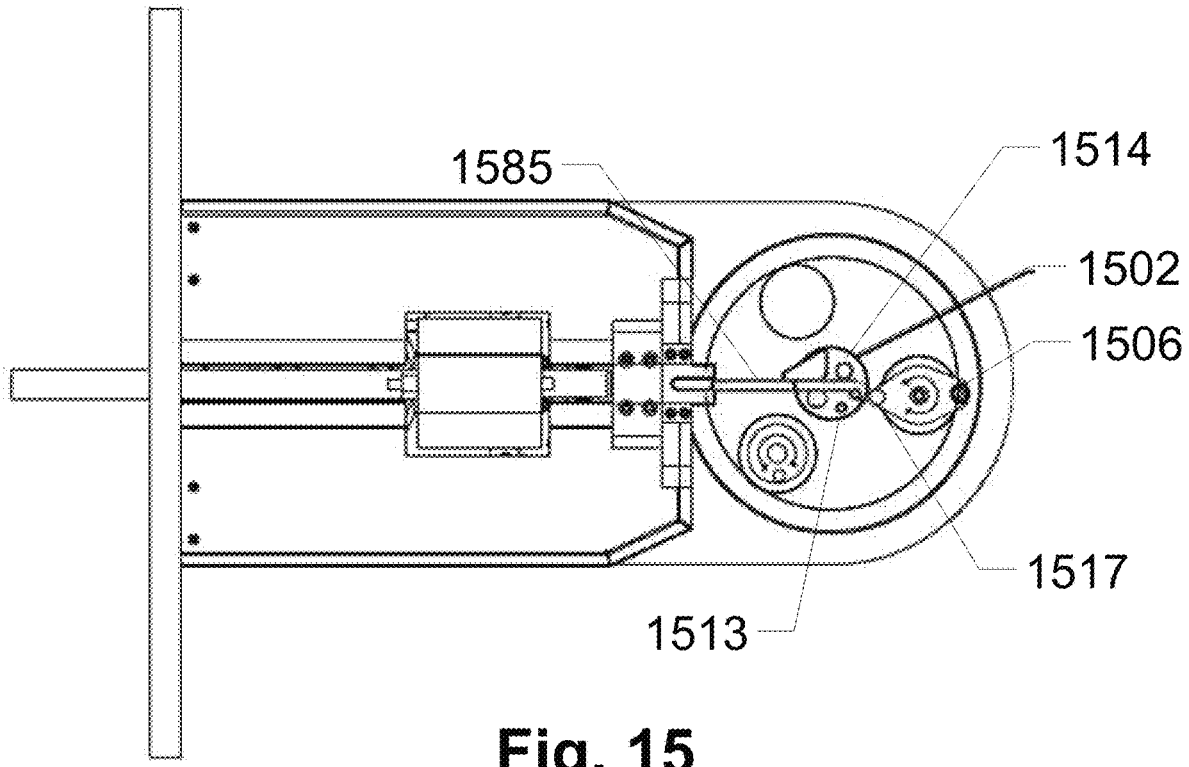
FIG. 15 shows a wire being fed into the center of the bending head assembly, according to an exemplary embodiment of the present invention.

FIG. 15 shows a wire 1585 being fed into the center of the bending head assembly through the middle of turret cluster 1502. Wire 1585 passes through turret cluster 1502 and exits between a small pin 1513 and a large pin 1514. Nose-bending mandrel 1506 is positioned near that exit where it is rotated so that bearing pin 1517 bends wire 1585 around small pin 1513 of turret cluster 1502. Only a small segment of wire is bent as this is merely a tool to complete a loop shown hereinafter.

Figure 16:
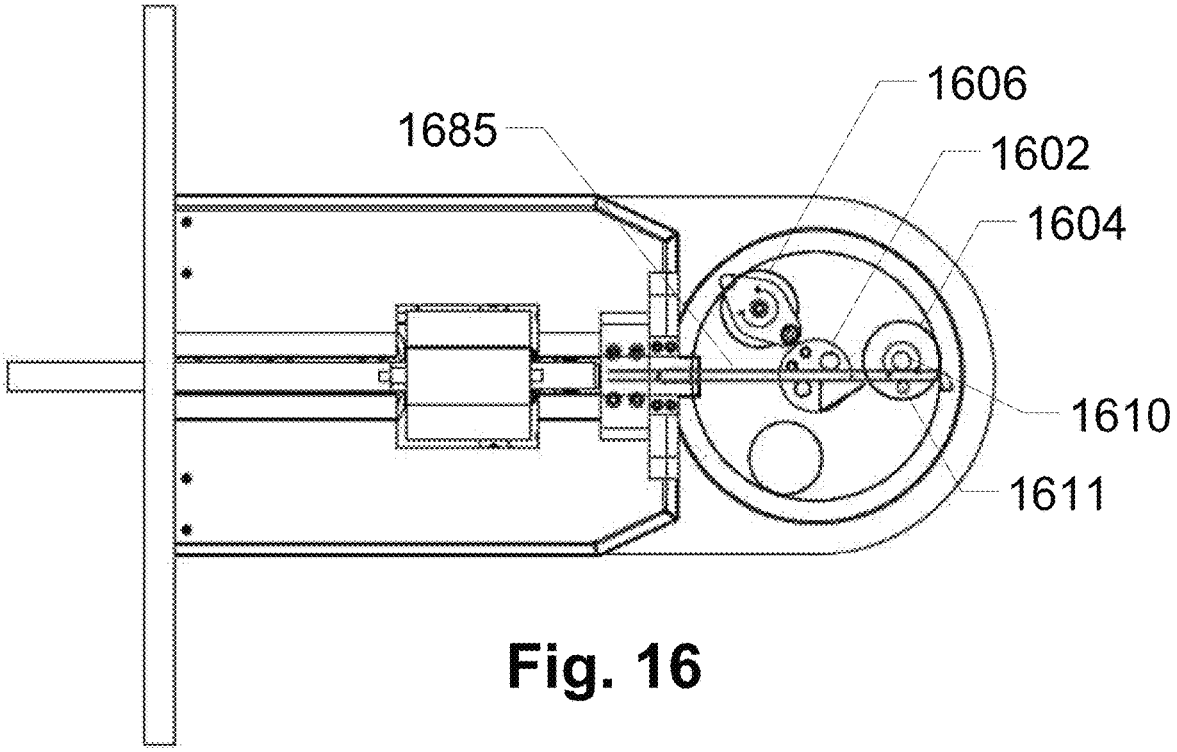
FIG. 16 shows a wire further fed through the turret cluster, according to an exemplary embodiment of the present invention.

FIG. 16 shows wire 1685 further fed through turret cluster 1602. Mandrel-bending mandrel 1604 and nose-bending mandrel 1606 are lowered before they revolve into position so that they do not manipulate wire 1685 while revolving toward their destination. Once in place the mandrel-bending mandrel rises to engage wire 1685. Wire 1685 now rests in between central pin 1610 and satellite pin 1611.

Figure 17:
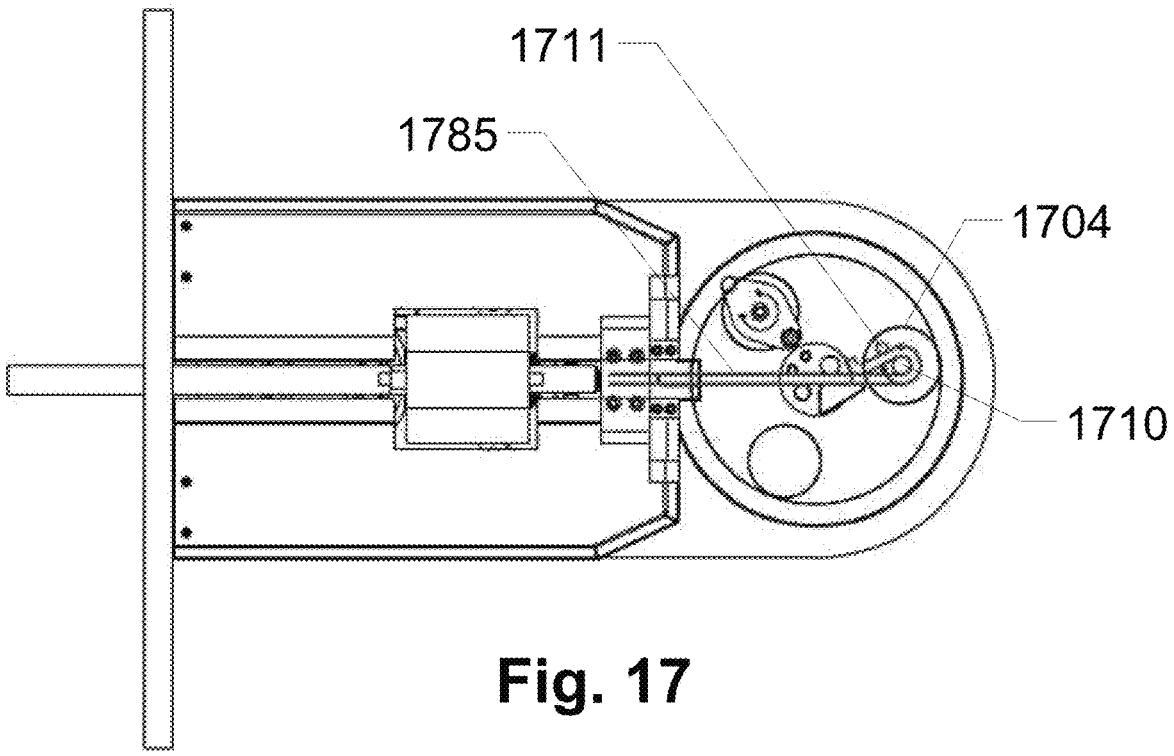
FIG. 17 shows a wire being manipulated by a mandrel bending head to form an end-loop, according to an exemplary embodiment of the present invention.

FIG. 17 shows wire 1785 being manipulated by mandrel-bending mandrel 1704 to form an end-loop. From the position shown in FIG. 16, mandrel-bending mandrel 1704 simply rotates. In doing so, satellite pin 1711 catches wire 1785 at the bend made in FIG. 15. This small bend allows satellite pin 1711 to pull wire 1785 around central pin 1710 until the first bend of wire 1785 touches wire 1785 again.

Figure 18:
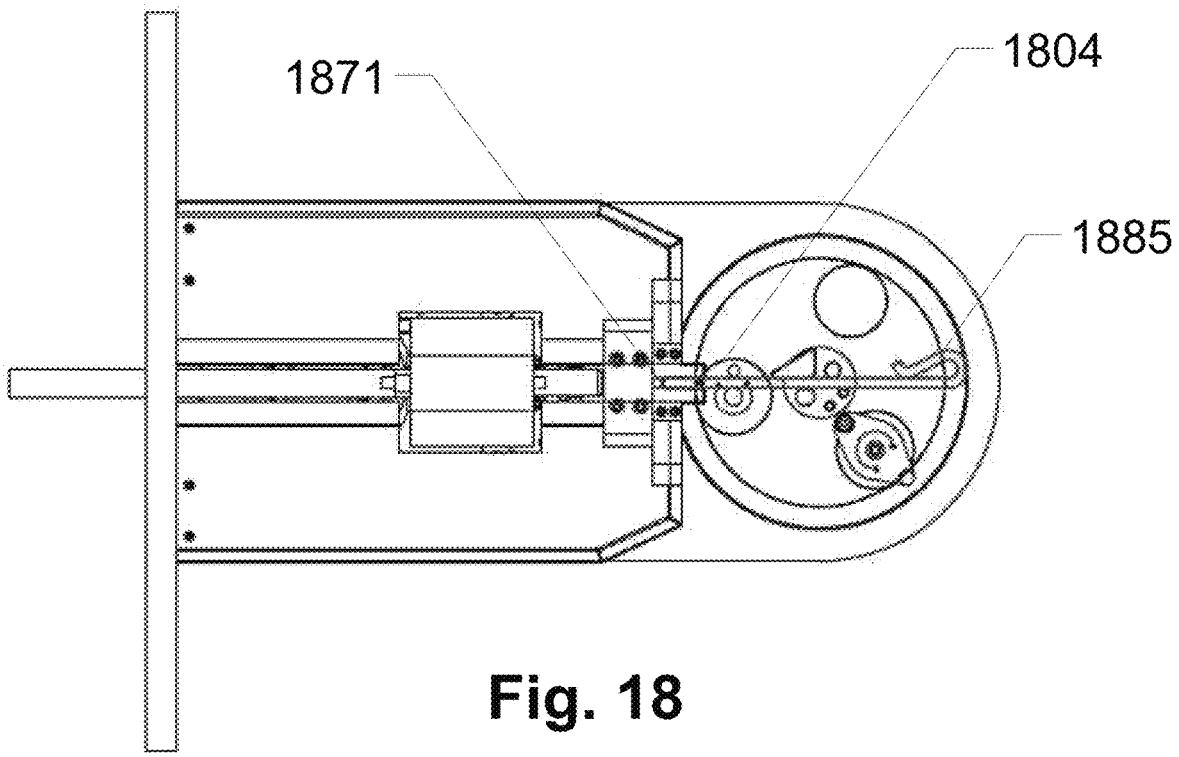
FIG. 18 shows a repositioning of a mandrel bending head, according to an exemplary embodiment of the present invention.

FIG. 18 shows a repositioning of mandrel-bending mandrel 1804 to the other side of the bending assembly where it engages wire 1885 at its opposite end. The mandrels are both lowered while revolving into position so that they do not manipulate wire 1885 during revolution. Wire cutter 1871 then cuts the wire forming a second end of wire 1885.

Figure 19:
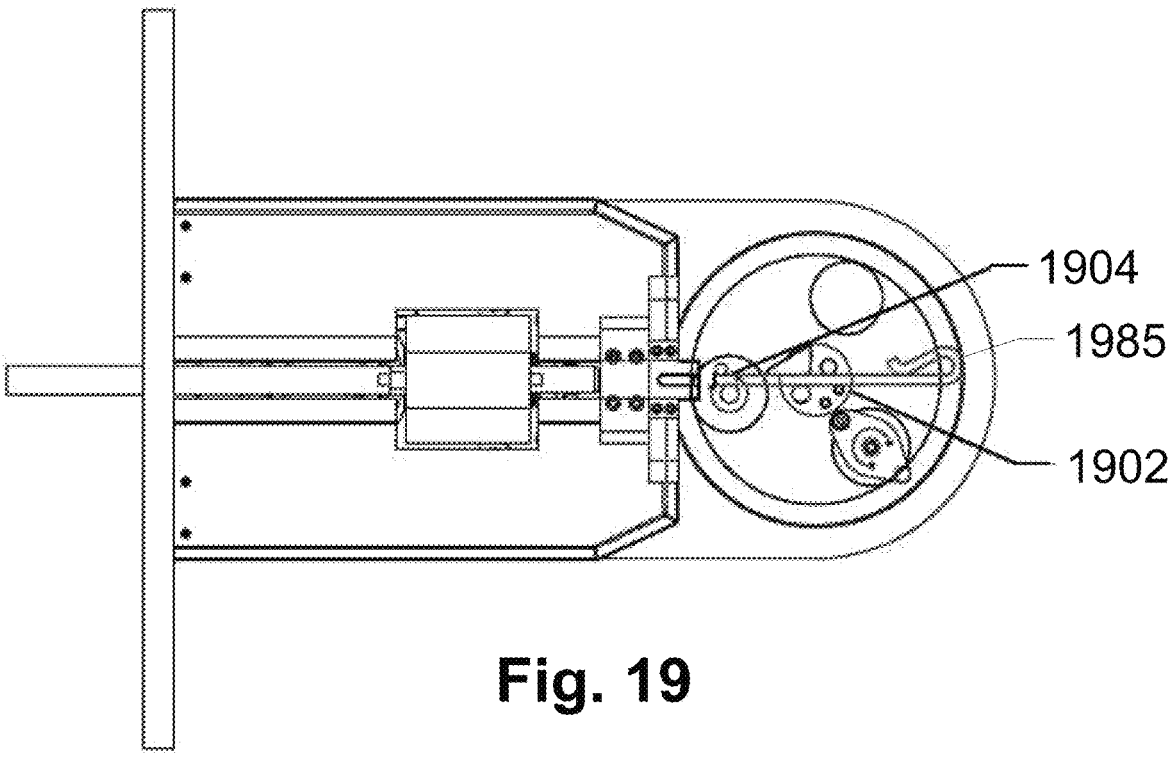
FIG. 19 shows a wire fed further through a mandrel bending head, according to an exemplary embodiment of the present invention.

FIG. 19 shows wire 1985 fed further through mandrel-bending mandrel 1904 and turret cluster 1902 while mandrel-bending mandrel 1904 rotates just slightly enough to pinch the second end of wire 1985 stopping and holding wire 1985 in place. This position sets up the next bend which is an off-plane bend.

Figure 20:
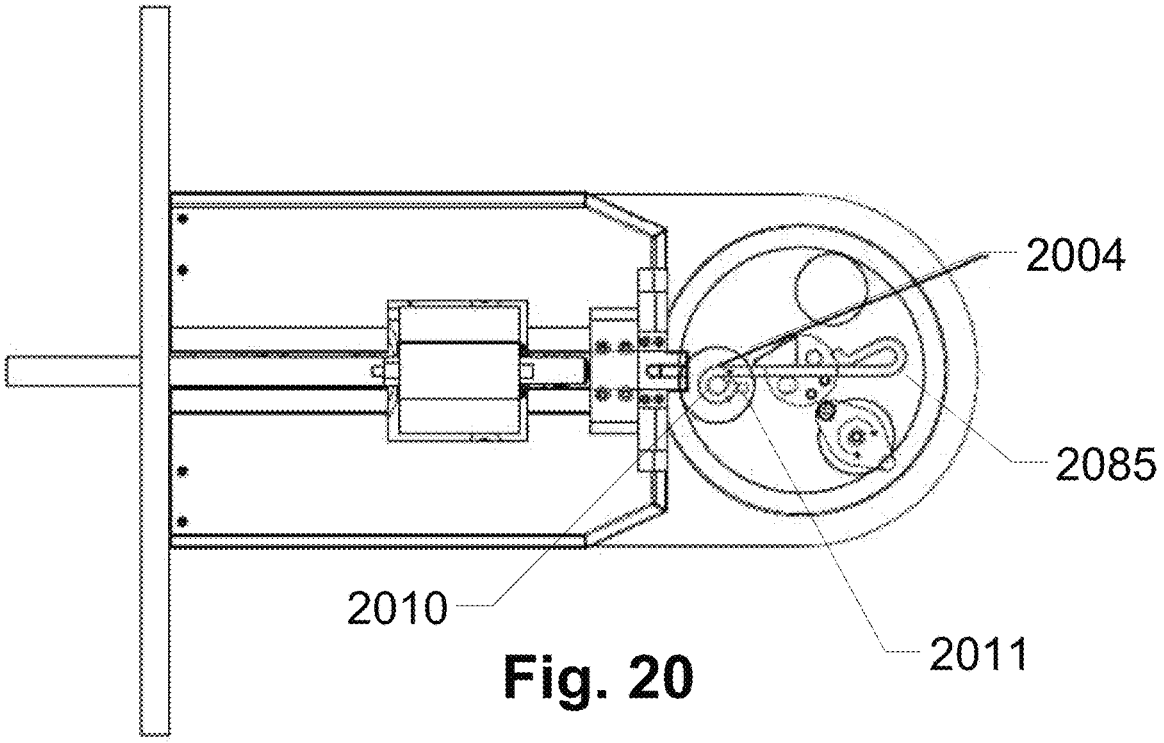
FIG. 20 shows a mandrel bending head manipulating a second end of a wire, according to an exemplary embodiment of the present invention.

FIG. 20 shows mandrel-bending mandrel 2004 manipulating the second end of wire 2085 to form another end-loop. With the second end of wire 2085 between central pin 2010 and satellite pin 2011, mandrel-bending mandrel simply rotates. While rotating, satellite pin 2011 pulls the second end of wire 2085 around central pin 2010 until the second end of wire 2085 touches wire 2085.

While the mandrel bend is performed in FIG. 20 the wire is pinched between the mandrel-bending mandrel and the triangular block of the turret cluster. Even though the wire appears to be running through the center of the bending surface, it is actually being pulled slightly off-center. Therefore, the mandrel bend in FIG. 20 can be referred to as an off-plane mandrel bend.

Figure 21:
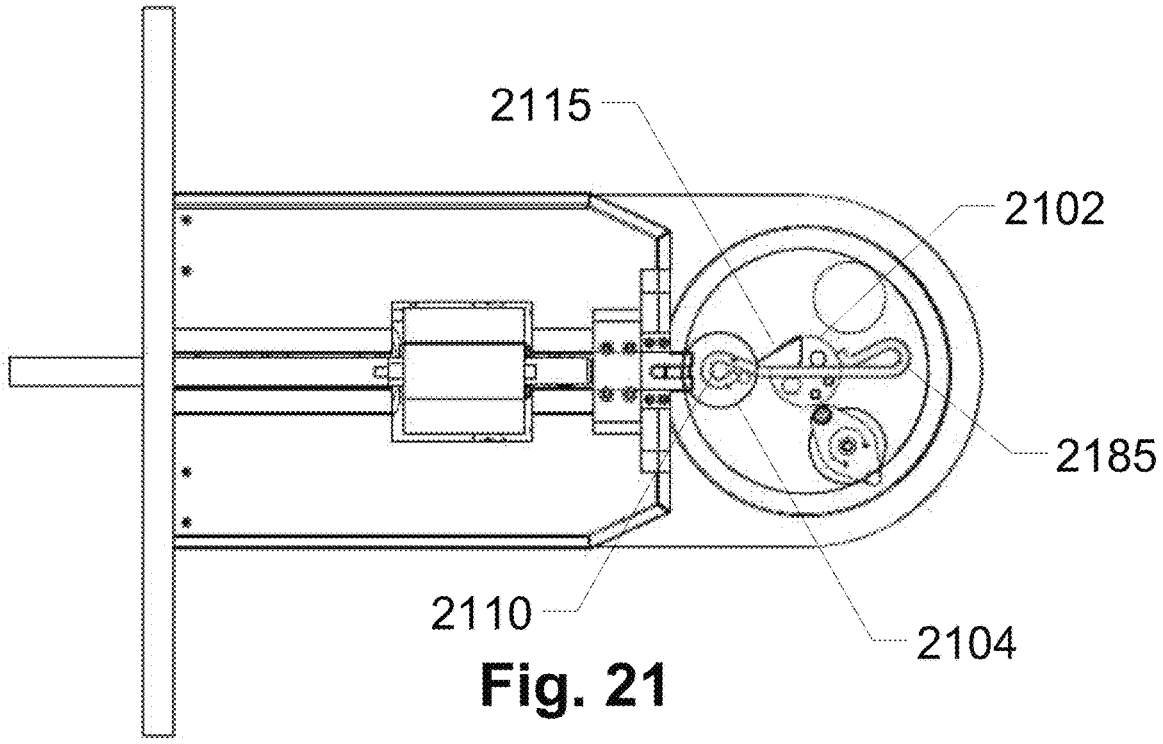
FIG. 21 shows a final bend in a wire to center a second end-loop, according to an exemplary embodiment of the present invention.

FIG. 21 shows a final bend in wire 2185 to center the second loop. While the end-loop at the second end of wire 2185 is still wrapped around central pin 2110, mandrel-bending mandrel 2104 revolves slightly around turret cluster 2102 to make a bend at the point on wire 2185 where the second end of wire 2185 meets wire 2185. The bend utilizes triangular block 2115 on turret cluster 2102 to make the bend. This bend may be made with the nose-bending mandrel as well, but the mandrel-bending mandrel can be used for higher efficiency since it is already in position to make the bend.

In this step the wire is still free from the wire feeder and is also slightly off of the wire centerline axis. The mandrel-bending mandrel is actually performing a nose-bend in the final bend shown in FIG. 21. Even though the mandrel-bending mandrel is performing this bend, because the wire is bent around the triangular block of the turret cluster, the bend is referred to as a nose bend. The central pin of the mandrel-bending mandrel acts as the strong or bearing pin of a nose-bending mandrel.

The foregoing disclosure of the exemplary embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A bending head for a wire bending device capable of both nose-bending and mandrel-bending operations, the bending head comprising:

a bending surface;

a turret cluster coupled to the bending surface, the turret cluster having at least one tool pin, the turret cluster configured to receive a wire adjacent to the bending surface and adjacent to the at least one tool pin wherein the wire defines a centerline;

a first mandrel coupled to the bending surface, the first mandrel configured to rotate around the turret cluster, the first mandrel further configured to raise, lower, and spin relative to the bending surface; and a second mandrel coupled to the bending surface, the second mandrel configured to rotate around the turret cluster, the second mandrel further configured to raise, lower, and spin relative to the bending surface;

wherein the wire bending device is capable of performing a programmable series of automated steps to create an off-plane bend by pinching the wire between the at least one tool pin and one of the first mandrel and the second mandrel and wherein one of the first mandrel and the second mandrel is positioned off of a centerline of the wire such that the wire is bent off of a normal wire centerline axis.

2. The bending head in claim 1, further comprising a wire feeder coupled to the bending head.

3. The bending head in claim 2, wherein the wire feeder comprises a plurality of feed rollers configured where two or more of the feed rollers are configured to clamp the wire and to deliver wire to the bending head device when the two or more feed rollers rotate along the length of the wire.

4. The bending head in claim 1, wherein the second mandrel comprises an interchangeable nose-bending tool.

5. The bending head in claim 4, wherein the interchangeable nose-bending tool further comprises a bearing pin.

6. The bending head in claim 1, wherein the first mandrel comprises an interchangeable mandrel-bending tool.

7. The bending head in claim 6, wherein the interchangeable mandrel-bending tool further comprises a central pin and a satellite pin configured to orbit around the central pin when the second mandrel spins relative to the turret cluster.

8. The bending head in claim 1, further comprising a pneumatic cylinder coupled to each mandrel.

9. The bending head in claim 8, further comprising a rotary union which distributes pneumatic pressure to each pneumatic cylinder; and wherein the rotary union comprises a hollow throughbore.

10. The device in claim 1, further comprising a CNC bending machine coupled to the bending head.

11. The bending head in claim 1, wherein the turret cluster is configured to selectively move between a raised position in which the at least one tool pin projects above the bending surface and a lowered position in which the at least one tool pin retracts below the bending surface.

12. The bending head in claim 11, wherein the at least one tool pin is selected from the group consisting of a substantially triangular tool pin and a cylindrical tool pin.

13. The bending head in claim 1, further comprising a wire cutting mechanism configured to cut a wire lying on the bending surface.

14. A bending head assembly comprising:

a bending head having a surface;

a wire feeding and cutting assembly adapted to deliver wire to the bending head through a centerline axis;

a turret cluster coupled to the bending head surface and having a plurality of bending pins;

a mandrel-bending mandrel having a central pin and a satellite pin and coupled to the bending head surface and capable of rotating around the turret cluster, the mandrel-bending mandrel capable of raising, lowering, and spinning independently of the turret cluster; and a nose-bending mandrel having a bearing pin and coupled to the bending head surface and capable of rotating around the turret cluster, the nose-bending mandrel capable of raising, lowering, and spinning independently of the turret cluster;

wherein the bending head assembly is capable of creating a bend off of the centerline axis by automatically pulling a wire slightly off center of the bending head and pinching the wire between a bending pin of the turret cluster and one of the mandrel-bending mandrel and the nose-bending mandrel, wherein one of the mandrel-bending mandrel and the nose-bending mandrel is positioned off of the centerline axis of the wire such that the wire is bent off of the normal wire centerline axis.

15. The bending assembly in claim 14, wherein the satellite pin is configured to orbit around the central pin when the mandrel-bending mandrel spins independently of the turret cluster.

16. The bending assembly in claim 14, wherein the mandrel-bending mandrel further comprises an interchangeable mandrel-bending tool and wherein the central pin and the satellite pin are disposed on the interchangeable mandrel-bending tool.

17. The bending assembly in claim 14, wherein the nose-bending mandrel further comprises an interchangeable nose-bending tool and wherein the bearing pin is disposed on the interchangeable nose-bending tool.

18. The bending assembly in claim 14, wherein the turret cluster is configured to selectively move between a raised position in which the plurality of bending pins project above the bending surface and a lowered position in which the plurality of bending pins retract below the bending surface.

19. The bending assembly in claim 14, wherein the plurality of bending pins are selected from the group consisting of a substantially triangular tool pin and a cylindrical tool pin.

* * * * *